52-77.1 S4
10/15/85 XR 4,546,530

United States Patent [19]

Rizk

[11] Patent Number: 4,546,530

[45] Date of Patent: Oct. 15, 1985

[54] METHOD FOR PRODUCING A MODULAR BUILDING UNIT

[75] Inventor: Jihad F. Rizk, Beirut, Lebanon

[73] Assignee: Polyfab S.A.R.L., Beirut, Lebanon

[21] Appl. No.: 504,365

[22] Filed: Jun. 14, 1983

[51] Int. Cl.[4] ..... B23P 11/00; E04H 1/00

[52] U.S. Cl. ..... 29/430; 29/155 R; 29/527.1; 29/772; 52/79.1; 52/79.14

[58] Field of Search ..... 29/430, 155 R, 772, 29/527.1; 52/79.1, 79.7, 79.8, 79.9, 79.14

[56] References Cited

U.S. PATENT DOCUMENTS

| | | | |
|---|---|---|---|
| 3,225,434 | 12/1965 | Van der Lely et al. . | |
| 3,256,652 | 6/1966 | Van der Lely . | |
| 3,289,382 | 12/1966 | Van der Lely . | |
| 3,292,327 | 12/1966 | Van der Lely . | |
| 3,377,755 | 4/1968 | Stucky et al. . | |
| 3,442,056 | 5/1969 | Van der Lely et al. . | |
| 3,470,660 | 10/1969 | Van der Lely et al. . | |
| 3,484,999 | 12/1969 | Van der Lely . | |
| 3,550,334 | 12/1970 | Van der Lely . | |
| 3,568,380 | 3/1971 | Stucky . | |
| 3,699,628 | 10/1972 | Gollobitz | 29/430 X |
| 3,738,069 | 6/1973 | Navarrette-Kindelan . | |
| 3,771,273 | 11/1973 | Brodie . | |
| 3,940,890 | 3/1976 | Postlethwaite . | |
| 3,958,320 | 5/1976 | Van der Lely | 29/430 |
| 3,962,773 | 6/1976 | Van der Lely | 29/430 |
| 3,994,060 | 11/1976 | Van der Lely et al. | 29/430 |
| 4,012,871 | 3/1977 | Netto et al. . | |
| 4,023,315 | 5/1977 | Stucky . | |
| 4,048,769 | 9/1977 | Van der Lely et al. . | |
| 4,065,905 | 1/1978 | Van der Lely . | |
| 4,077,170 | 3/1978 | Van der Lely . | |
| 4,443,992 | 4/1984 | Shechter | 52/79.1 |
| 4,450,617 | 5/1984 | Dillon | 29/430 |

*Primary Examiner*—Howard N. Goldberg

*Assistant Examiner*—Ronald S. Wallace

*Attorney, Agent, or Firm*—Wellington M. Manning, Jr.

[57] ABSTRACT

A process for fabricating a building module is disclosed and claimed. The building module includes a load bearing frame, preferably utilizing metal components welded together. The frame is produced in subsections, namely two portal frame subsections, a floor frame subsection, a roof frame subsection, and optionally cantilever section frame subsections. The various frame subsections are assembled with the use of jigs which monitor correctness of the appropriate components, after which the subsections are transferred to a final frame assembly site, where they are located on jigs which properly position same with respect to other subsections, after which the subsections are secured to each other to form a unified module frame. The frame is then lifted and casters or the like are removably secured to a lower portion of same, whereby the completed frame may be moved, preferably on a trackway, past a plurality of finishing stations where predetermined further assembly steps are performed at each such station. In a most preferred embodiment, a monolithic concrete slab floor is utilized in conjunction with the module frame with pouring formwork removably secured to the frame at the final assembly site for movement with the frame to a pouring station where the concrete is cast into the formwork, finished and cured. Thereafter the formwork is removed and the frame is moved past the remaining module finishing stations. A building module may thus be virtually completed in a factory environment, except for fabrication steps that are required to be conducted at the building site relative to association of one module to another to ensure coplanarity of adjacent surfaces and to properly locate the module on an appropriate foundation.

13 Claims, 24 Drawing Figures

METHOD FOR PRODUCING A MODULAR BUILDING UNIT

BACKGROUND OF THE INVENTION

The present invention relates to a method for production of a modular building unit. Individual modules or units are at least substantially completed in a factory environment according to a predetermined design, after which they are transported to a proposed building site where they are set in place as a single module structure, or are coupled to other modules to yield a composite building. A significantly short period of time is consumed at the building site due to the high degree of completion of the unit achieved at the factory.

Modular concepts of construction, in which individual building modules are pre-fabricated, moved to a building site, and secured to additional modules to produce a desired structure are well established in the art. Similarly other known modular techniques involve remote prefabrication of components followed by component erection and completion of the structure at the building site. Generally speaking, however, both of the noted prior modular concepts have been fraught with problems and/or inherent limitations, such that the use of same has been severely limited. Specifically, while transport of a prefabricated module has precluded use of many conventional materials and has limited architectural design due to dimensional and structural considerations, prefabrication of components only, through less stringent in transport restrictions is both labor intensive and time consuming at the building site.

Exemplary of prior attempts at prefabrication of modules include the manufacture of rectangular-shaped modules which are limited in design and use by virtue of the necessity for supports internally of the modules. Such internal supports limit coupling of modules, restrict placement of internal walls within the module, or protrude into the intended useable interior where the supports must be enclosed, presenting aesthetically undesirable interior module features. In general, necessity for the internal supports has been dictated by lack of structural integrity of the system, per se, and in fact, one such system employs one or more temporary vertical supports during the manufacture of the module which remain in place until the modules are connected into a composite structure, at which time additional hidden supports are provided, adequate to permit the removal of the temporary internal supports, whereby an unobstructed interior of at least a portion of the composite structure is achieved.

Other systems avoid the above noted problem by designing the module so that critical support elements are located around the exterior of the module. In these systems, though the interior of the modules may be unobstructed, the exterior becomes potentially aesthetically unappealing. Further, in both of the above described systems, the structural frames employed limit the modules to use in a totally cubic deployment.

Due to the lack of structural integrity of the individual prefabricated modules of the prior art, individual modules are generally assembled into a composite building with the aid of tensioning cables, tie rods, rigid support couplings, support beams that extend across joints between modules and the like. These various means that are utilized to strengthen the prior art modules are adequate to perhaps properly unite adjacent modules into an overall structure, but are not adequate to overcome the patent lack of structural integrity of the modules per se which may be ascertained simply by movement about the interior of the structure. By way of exmmple, one outstanding nticeable feature of normal modular construction is a lack of stability and rigidity of the floor. Normally floors in prefabricated, transportable structures exhibit resilience when one walks thereacross due to a lack of strength or rigidity that is exhibited by conventional flooring.

Prior attempts to overcome the noticeable floor effect of prefabricated construction have included fabrication of the floor from a reinforced concrete floor or conventional materials at the building site, or the placement of structural reinforcement beneath the module at the building site, all of which detracts from the efficiencies of the system, per se. In fact, prior to the present invention, there has been no modular construction system that has employed a factory fabricated lightweight, reinforced concrete floor in the module which could be successfully transported from the factory to the building site without damage to the floor.

Prior art modular building systems involving fabrication of modules in a factory, followed by transport of the virtually completed module to a building site have followed two general structural techniques. One such technique includes exterior load bearing walls to achieve the degree of structural integrity and rigidity necessary for transportability of the module, and in fact, such modules generally include exterior load bearing walls of reinforced concrete, which are both architecturally and aesthetically limiting to the system. The second structural technique for such modular systems involves the inclusion of a load bearing structural framework to which non-load bearing exterior and interior walls are suitably affixed. Vertical load bearing columns are utilized in the framework, generally located at the four corners of the rectangular shaped module and at intermediate locations therebetween. The vertical columns may be secured between horizontal structural elements of the framework for the floor and roof of the module, or alternatively, the horizontal framework elements may be secured to the columns. Such structural framework arrangements of the prior art possess inherent disadvantages due to the requirement for intermediate supports between corner vertical supports, exposure of the vertical support columns around the exterior of the module, or the necessity to enclose the protruding vertical columns within the interior of the module.

All in all, reflecting on prior art modular construction systems, no system has existed heretofore in which basically conventional construction materials have been utilized as normally found in an office, an industrial building, or a dwelling totally constructed on site. With the present invention, however, such modules may be efficiently produced in virtually completed form in the factory, and are then transportable to the building site. At the building site the modules are placed in the appropriate configuration according to the intended design for the structure, and adjacent nodules are coupled to each other to ensure continuity of planar surfaces of the modules, such as the walls, floors, ceilings and the like, and generally without the necessity of significant additional structural coupling of the modules.

Insofar as the present process for producing a building module is concerned, the steps followed are quite efficient and quite accurate. The actual design of the individual module as dictated by the particular building design with which the module is to be employed may be produced with little or no deviation from the standard process of assembly. The process of the present invention is designed to permit multiple functions to be carried out simultaneously while each separate function is individually controlled to minimize chance for error, while at the same time affording great overall flexibility.

Though the process of producing a building module according to the present invention follows a production line technique, and production line techniques generally have been known and used heretofore for production of building modules, there is no known prior art that is believed to anticipate or suggest the present invention. Exemplary of the known prior art are the following United States patents.

| | |
|---|---|
| U.S. Pat. No. 3,225,434 | U.S. Pat. No. 3,568,380 |
| U.S. Pat. No. 3,256,652 | U.S. Pat. No. 3,738,069 |
| U.S. Pat. No. 3,289,382 | U.S. Pat. No. 3,771,273 |
| U.S. Pat. No. 3,292,327 | U.S. Pat. No. 3,940,890 |
| U.S. Pat. No. 3,377,755 | U.S. Pat. No. 4,012,871 |
| U.S. Pat. No. 3,442,056 | U.S. Pat. No. 4,023,315 |
| U.S. Pat. No. 3,470,660 | U.S. Pat. No. 4,048,769 |
| U.S. Pat. No. 3,484,999 | U.S. Pat. No. 4,065,905 |
| U.S. Pat. No. 3,550,334 | U.S. Pat. No. 4,077,170 |

SUMMARY OF THE INVENTION

It is an object of the present invention to provide an improved process for producing a building module.

Another object of the present invention is to provide an improved process for producing a building module in a factory environment, which process ensures accuracy while permitting architectural flexibility in use of the module being produced.

Still another object of the present invention is to provide an improved process for producing a building module which building module is to be transportable from a factory to a building site and which module will undergo transit for a substantial distance without any significant damage to the module or components of same.

Yet another object of the present invention is to provide an improved process for producing a building module where frame subsections are first produced and thereafter moved to a central location for final assembly of a module frame, after which the module frame is moved along a trackway where it is finished in step-by-step fashion.

Generally speaking, the process according to the present invention for producing a building module comprises the steps of fabricating a skeletal module frame; removably securing concrete floor formwork to said frame; moving said module frame with said formwork removably secured thereto to a remote location and pouring a concrete floor within said formwork; finishing and curing said concrete floor and removing said formwork from said frame; intermittently moving said module frame with said concrete floor therein past a series of stations, and further finishing predetermined portions of said module at each said station, whereby when said module leaves said last station, said module is complete, awaiting transit to the building site.

The process of the present invention for producing a building module preferably involves the fabrication of a module frame from structural steel components which includes the steps of producing two portal frame subsections, a floor frame subsection, and a roof frame subsection; moving said frame subsections to a common location; associating said frame subsections relative to each other by the use of jigs for same, which jigs properly position said subsections for securement; securing said subsections into a unified module frame structure; lifting said assembled frame; removably associating transport means, such as casters with a portion of said frame, said transport means preferably being receivable on a trackway; removing said final assembly jigs from said frame and thereafter moving said assembled frame along said trackway past a plurality of finishing stations, and conducting predetermined further module assembly steps at each station.

More specifically, the process of the present invention is designed to facilitate efficiency of fabrication, while at the same time, permitting design flexibility without a significant likelihood of error. Subsections of the individual frame components are assembled at separate locations, with each particular subsection being produced according to the design of the module to be fabricated, such that once the subsections are transferred to a final assembly site, the module frame will automatically include such design features. By way of example, building modules produceable according to the present invention, as mentioned above, preferably include a load-bearing structural steel frame which supports the entire weight of the finished module, and which has no load bearing walls associated therewith. Assembly of the subsection components into the module frame will not deviate generally except for the presence or absence of cantilever sections. The floor or roof subsections may, however, vary according to the module design. Floor and roof subsections could, for example, exclude certain components should a portion of the frame be designed to remain open to accommodate a stairway subsection or the like, or to simply afford an open space in the composite structure.

Each frame sub-assembly area is provided with jigs for the particular sub-assembly, with each jig being designed such that placement of the component parts at respective locations on the jig automatically confirms, even to an unskilled worker, that the individual component is appropriate. The component parts are pre-prepared and need only be placed in the jig where they are secured to each other to produce the particular frame subsection. According to a most preferred embodiment of the present invention, the module frame is steel, all component parts are steel, and the component parts are welded to related component parts for securement.

Once the frame subsections are completed, same are transported by overhead cranes to the final assembly site where the following preferred sequence of steps take place. A portal frame is set atop pins provided on the floor with pins extending from an upper end of same being engaged by jig elements that are pivotally secured to jigs extending longitudinally along opposite sides of the assembly site. The portal frame is thus held in a proper vertical disposition.

Thereafter, a floor frame subsection is appropriately positioned adjacent the portal frame where it is supported by a protuberance from the portal frame columns. With the floor frame held at the proper location for securement to the portal frames, a second portal frame is positioned at an opposite end of the floor subsection in like fashion as the first portal frame and the floor subsection is associated therewith. A roof frame subsection is then lowered into position between the portal frames, where same is received by jig elements that are pivotally secured to the longitudinal extending jigs. The roof supporting jig elements receive and secure a portion of the roof subsection to correctly locate same for securement to the portal frames. In this fashion, once the frame subsections are properly located each is thereafter appropriately secured to adjacent subsections to unify the entire frame structure. All of the jigs, jig elements and supports are positioned to automatically locate the subsections for securement.

Subsequent to securement of the frame subsections to each other to define the overall module frame, the jig elements are moved away from the portal frames and roof and the hydraulic jack is extended to lift the module frame from the floor, whereby means, exemplified by casters, wheels or the like are removably secured thereto, preferably to the vertical columns of the portal frames to support the frame for movement. Casters are preferably employed which are receivable on a trackway located at the assembly site and extending past the remaining finishing stations, along which the frame may be moved for further completion of the module. The preferred casters are adapted to receive connector elements between adjacent modules whereby a train of modules may be formed and moved simultaneously by a single power source.

In a most preferred embodiment, the floor utilized in conjunction with building modules produced according to the present invention are monolithic, reinforced concrete slab floors. The floor subsection when brought to the final assembly site includes upstanding shear connectors or other concrete reinforcing elements. At the final frame assembly site, and during or after assembly of the module frame, wire mesh and possibly other reinforcing elements may be positioned over the area of the floor frame that is intended to receive the monolithic concrete slab. In a preferred embodiment according to the present invention, formwork for production of the monolithic concrete slab floor is removably secured to the module frame at the final assembly site for transport with the frame to a remote location where the concrete floor is poured, finished and cured.

Also in a most preferred embodiment, while at the final assembly point, once the module frame is unified, sheet materials such as plywood are secured to the portion of the roof frame intended to receive same for the production of a planar roof, and a waterproof membrane is thereafter secured across the sheet materials. In order to accommodate production of the basic roof on the module frame while at the final assembly site, the longitudinal jigs located thereat include catwalks along which workers may move and work at roof level of the frame. Also by securement of the basic roof to the module frame at the final frame assembly site, the frame is covered, whereby the unit can be transferred to an exterior location for further completion. Capital costs for a suitable manufacturing facility are thus reduced.

Once the module frame is completed, same can then be moved to a next station, preferably where the concrete floor is produced in situ. Preferably, a plurality of completed frames are collected at the concreting station, after which floors for the group of frames are poured sequentially. Thereafter, all of the floors are appropriately finished, preferably by power floating, and are then moved to a concrete curing station, where preferably, accelerated curing of the concrete is achieved by use of quick curing concrete or heat as may be provided by electrical blankets or the like.

Following completion of production, finishing and curing of the concrete floor, the modules are then moved in sequential fashion individually, or as a group past a plurality of finishing stations, where such further materials as may be required are added to the module to virtually completely finish same prior to transit to the building site.

DESCRIPTION OF THE PREFERRED EMBODIMENTS

Figures 1, 1A:
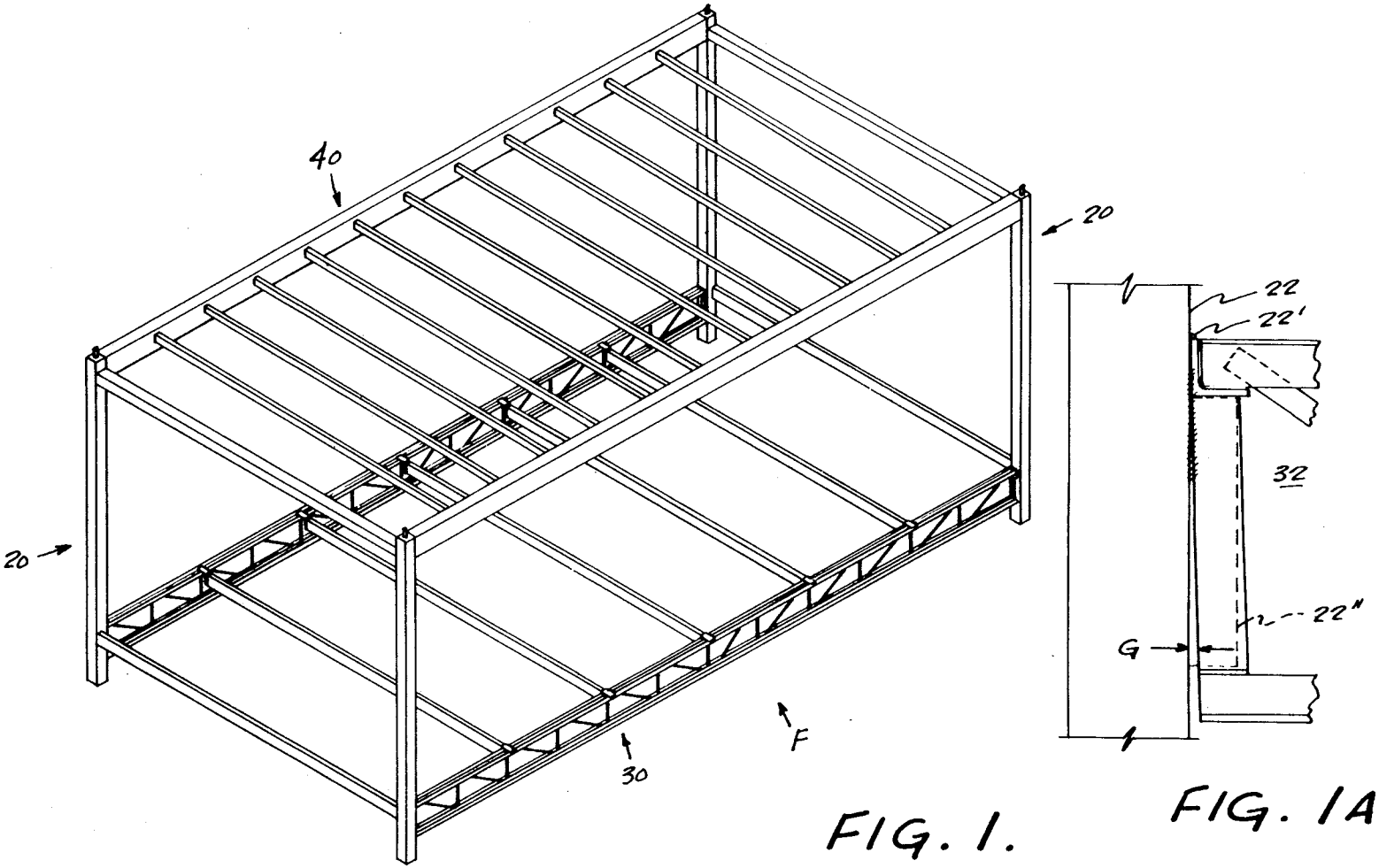
FIG. 1 is an isometric view of a basic module frame.
FIG. 1A is a partial elevational view of a portion of a portal frame and a floor frame, illustrating initial securement therebetween.
Figure 2:
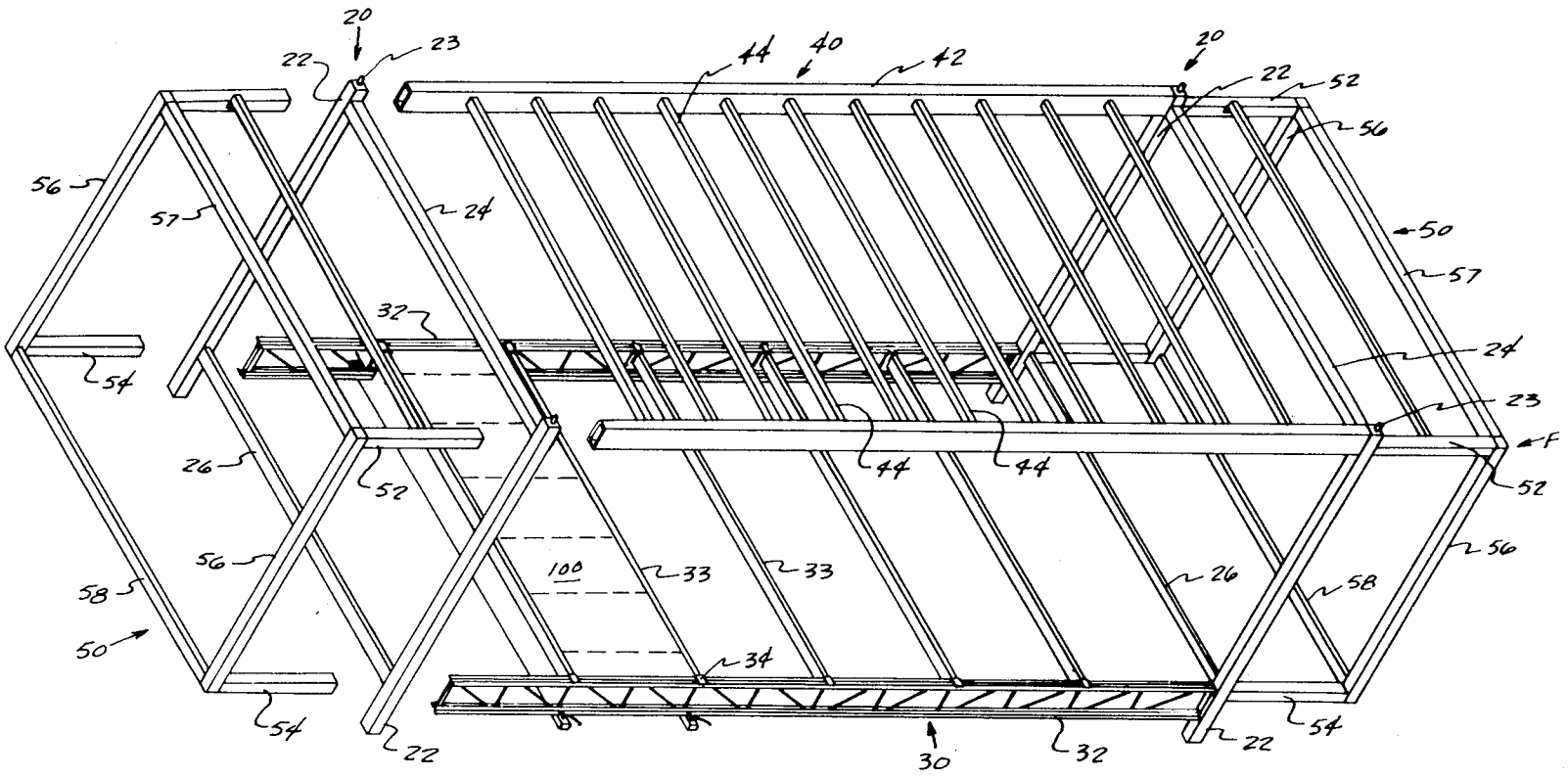
FIG. 2 is a partially exploded view of a cantilevered module frame.
Figure 3:
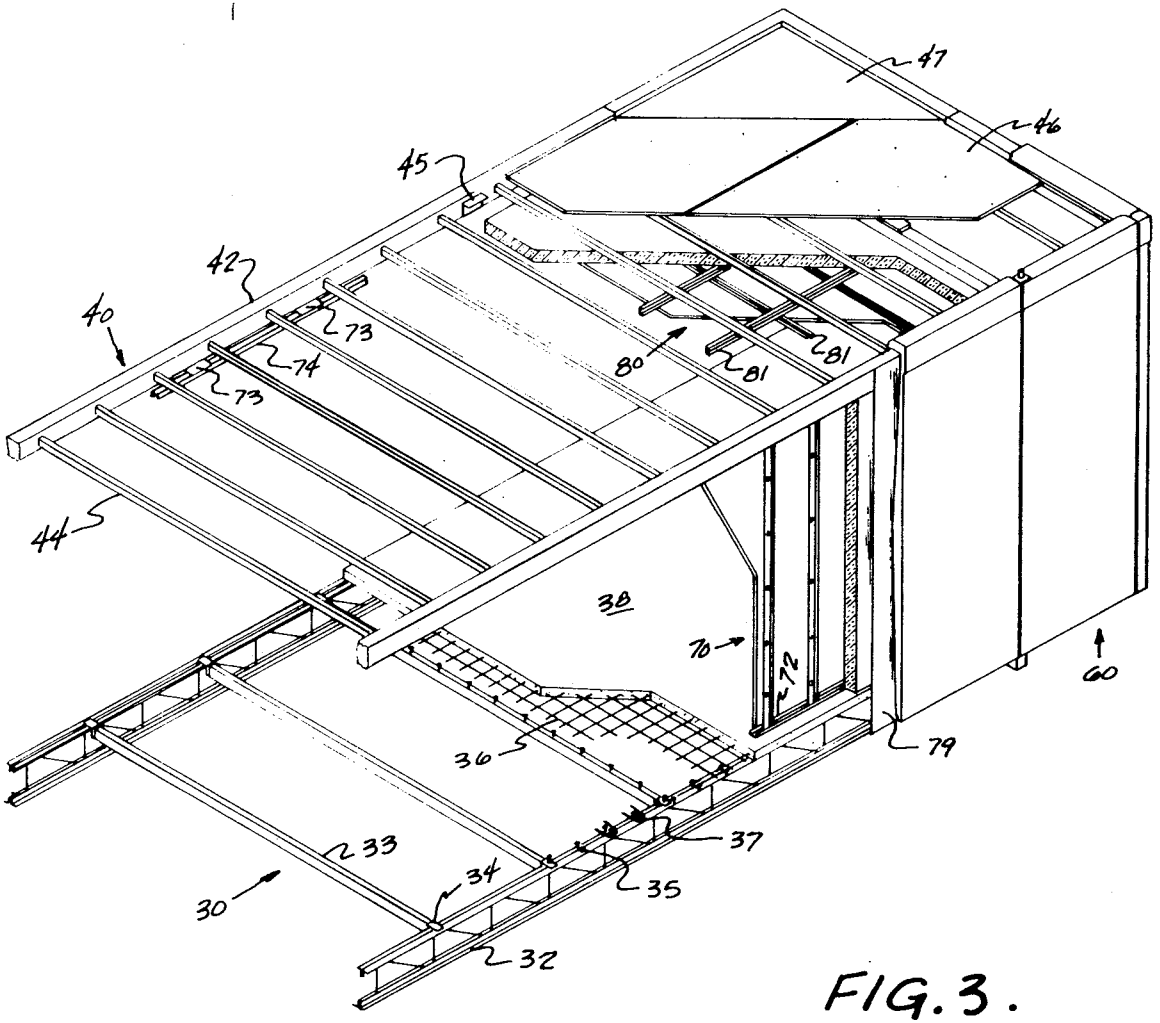
FIG. 3 is a partial cut-away isometric view of a module illustrating the major component parts of same.
Figure 4:
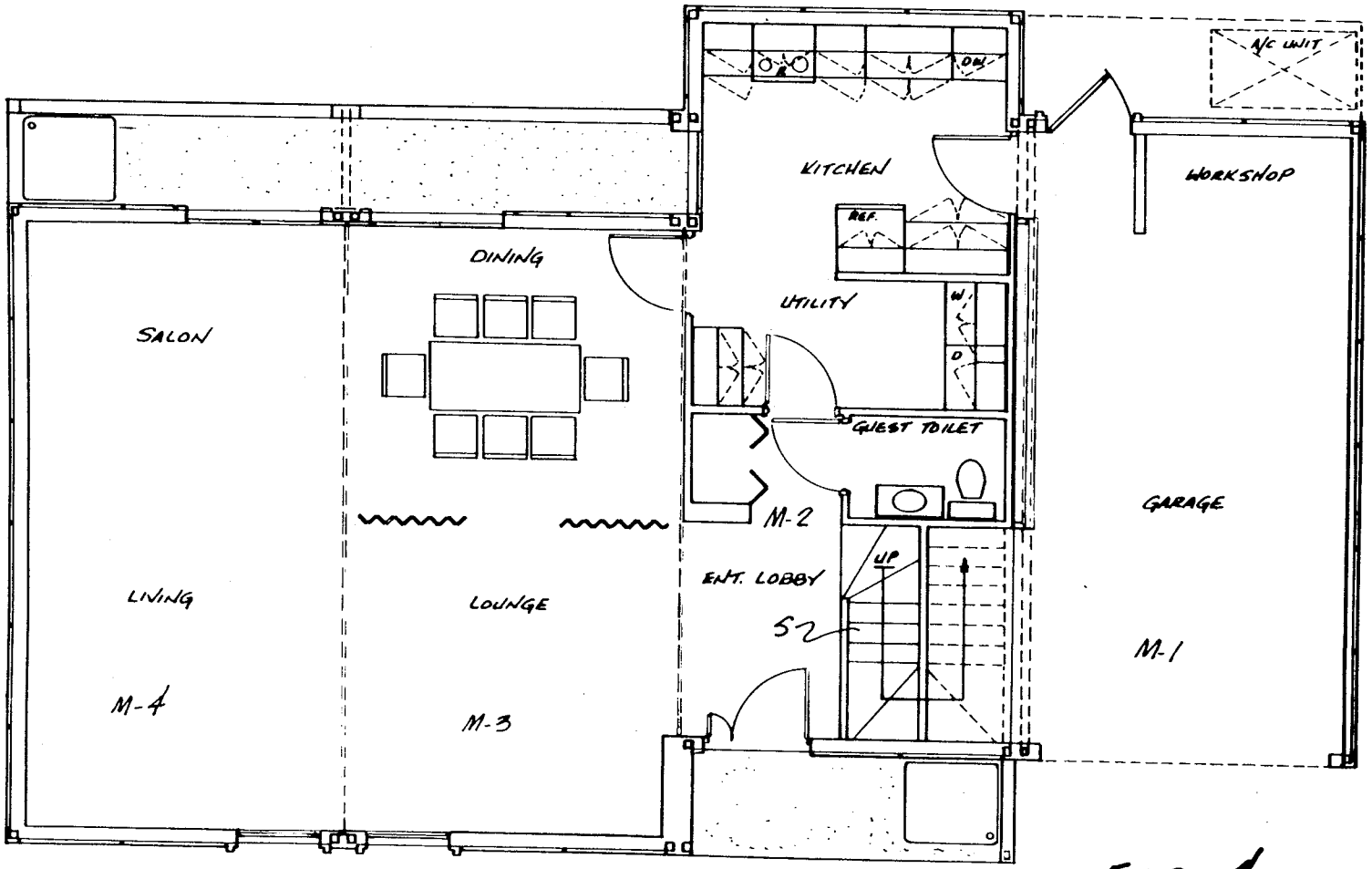
FIG. 4 is a floor plan of a first floor of a typical building produced from modules according to the present invention.
Figure 5:
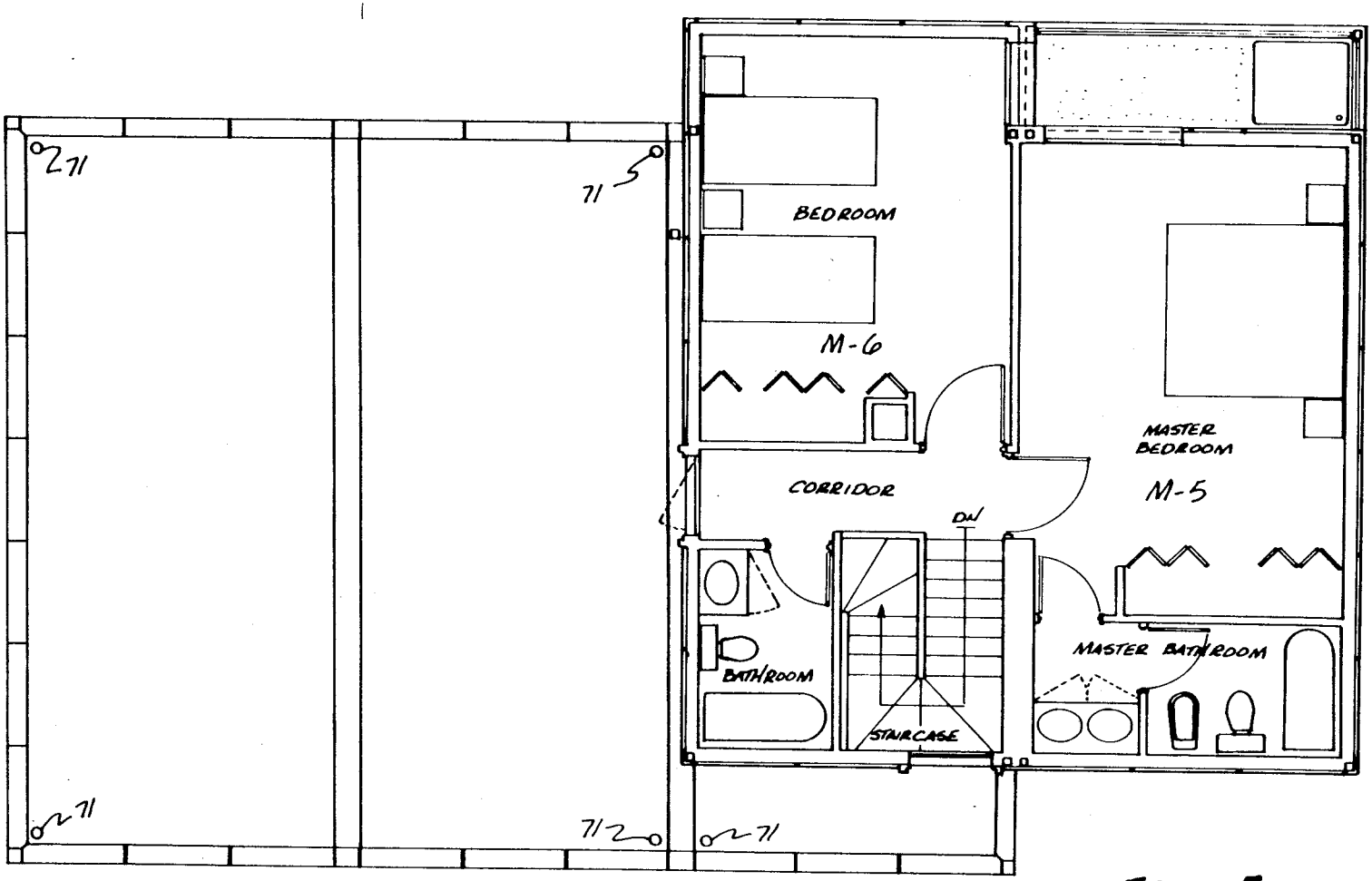
FIG. 5 is a floor plan of a second floor of a typical building.

Referring to the Figures, preferred embodiments of the present invention will now be described in detail. FIGS. 1 through 3 illustrate preferred embodiments of building modules produceable by the process of the present invention, while FIGS. 4 and 5 illustrate typical floor plans for a two-story building that may be formed by a plurality of such modules in side by side and vertically stacked disposition.

FIG. 1 illustrates a basic frame for a module generally indicated as F which is made up of a plurality of frame subsections. Two portal frame subsections generally indicated as 20 are provided at opposite ends of frame F with a floor frame subsection generally indicated as 30 secured between a lower end of same and a roof frame subsection generally indicated as 40 secured at an upper end of same. Also as illustrated in FIG. 2, cantilever frame subsections generally indicated as 50 may be secured to the outer edges of portal frames 20 and extend outwardly therefrom. Portal frame subsections 20 include two vertical columns 22 which are spaced apart to generally define a width of a frame being produced, and which have upper and lower horizontal beams 24 and 26, respectively, secured therebetween, inwardly from the upper and lower ends of columns 22. Additionally, vertical columns 22 preferably have connector pins 23 secured to upper ends of same, extending upwardly therefrom, while having connector pin receiving openings 25 defined in a lower end of same (See FIG. 22).

Floor frame subsection 30 includes a pair of open web trusses 32 that extend in a longitudinal direction of the module and which have a plurality of floor purlins 33 secured therebetween in spaced apart relationship along the length of trusses 32. Particularly, floor purlins 33 have L-shaped brackets 34 secured at opposite ends of same with one leg of brackets 34 being secured atop trusses 32. Trusses 32 and floor purlins 33 have a plurality of reinforcing elements, preferably shear connectors 35 secured therealong and extending upwardly therefrom to be encapsulated in a monolithic concrete slab to be produced in situ thereabout (See FIG. 3). Additionally, a reinforcing mesh 36 is at some time during the assembly process, supplied over a portion of floor frame 30 where the concrete floor is to be produced, and under certain circumstances, a plurality of reinforcing clips 37 may also be received about peripheral reinforcing elements 35 to further reinforce peripheral edges of the concrete floor. As will be described in more detail hereinafter, a monolithic concrete slab 38 is produced in situ atop floor frame 30, encapsulating reinforcing elements 35, mesh 36, and reinforcing clips 37, if present. When assembled into frame F, trusses 32 are secured at opposite ends to vertical columns 22 of portal frames 20.

Roof frame subsection 40 includes a pair of longitudinally extending tubular beams 42 having a plurality of roof purlins 44 secured therebetween. As will be described in more detail hereinafter, roof purlins 44 are secured according to a predetermined arrangement to define a predetermined slope to a roof secured thereto. Further as will be discussed in more detail hereinafter, a plurality of subroofing sheets 46, such as plywood, may be provided atop roof purlins 44 and secured thereto with self-threading screws or the like. In a preferred arrangement, adjacent sheets 46 are adhesively secured to each other. Likewise, depending upon the structural rigidity required of the module, a plurality of brackets 45 may be secured to tubular beams 42 along the length of the module between purlins 44 such that the peripheral edge of the roof sheets 46 may be firmly secured to frame F. Once plywood sheets 46 or the like are secured to the roof purlins 44, a waterproof membrane 47 such as a polymer film may be secured to an upper surface of sheets 46 entirely across the intended roof portion of the module.

Making particular reference to FIG. 2, the cantilever frame subsections 50 are illustrated, having longitudinal tubular beams 52 and 54 at the upper and lower portions of same respectively, and with each of the longitudinal beams 52 and 54 being secured at one end to an outside of the vertical columns 22 of the portal frames and at an opposite end to a vertical beam 56. Upper and lower transverse horizontal tubular beams 57 and 58 are then secured between the vertical beams 56 to define the frame subsection for cantilever sections 50. As shown in FIG. 2, a roof purlin 44 may also be secured according to a particular slope design between upper tubular beams 52 of cantilever sections 50. Though two such cantilever sections 50 are illustrated in FIG. 2, only a single cantilever section 50 may be provided, at either end of frame F.

Once frame F is produced according to the process of the present invention, the remaining components and fixtures for the particular module may be added thereto. In a general order of addition, the plywood sheets 46 and the waterproof membrane 47 are preferably applied at the final assembly site for frame F. Frame F is then jacked up, the mounting pins removed from beneath the portal frame columns, and casters receivable on a trackway are removably secured thereto. Module frame F may then be conveniently moved from station to station for completion of fabrication. Basic components for the preferred building module are shown in FIG. 3 and include a floor 38 produced in situ about floor frame 30 which covers all or a portion of the module frame according to the design of the particular module being produced. With the frame completed and the floor and roof installed, appropriate materials are thereafter included to frame up interior peripheral and partition walls according to the particular module design. Such in a preferred embodiment includes the rigid securement of stud runners 72 to concrete floor 38, while upper stud runners (not shown) are flexibly associated with an upper portion of frame F, stud runners 72 may be secured directly to flexible brackets 73 that are in turn secured to an upper frame beam, e.g., tubular beam 42, to a strut 74 secured to flexible brackets 73, or to one or more struts 81 that constitute a ceiling grid 80. Once upper and lower stud runners 72 are secured, one rigidly and one flexibly, wall studs 75 may be secured therebetween, thus defining skeletal frames for interior walls 70. With the stud walls in place, electrical and plumbing service lines, etc., insulation or the like may be located therewithin.

A vapor barrier material 79, preferably fabric reinforced polyethylene sheets, may then be secured to frame F along the height of same, and around the segment of the module to be enclosed. Exterior cladding walls 60 may then be secured to frame F, preferably cooperating with vapor barrier 79 to define a ventilating passageway therebetween. Cladding walls generally 60 may be plain panels as illustrated in FIG. 3, or may take various and sundry shapes, to accommodate corners, to serve as coping, to receive window units, door units, air conditioning units or the like, enabling the module to be produced according to the design scheme of the structure in which it is to be employed. Cladding walls 60 also have an inturned flange section 62 at an upper end of same which extends beyond frame F over the roof of the module.

While the module in general has been described above, further structural details relating to same may be had by referring to copending application Ser. No.

06/504,226, entitled "Modular Building System and Building Modules Therefor", being filed concurrently herewith, the subject matter of which is incorporated herein by reference.

Making reference to FIGS. 4 and 5, typical floor plans for a two story structure utilizing modules produced according to the present invention are illustrated. FIG. 4, for example, illustrates a first floor of such a structure where four modules M-1, M-2, M-3, and M-4 have been set side-by-side on appropriate foundations and associated to ensure coplanarity of adjacent surfaces. While it is believed that the intended utilization for the interior of each of the four modules is self-evident, several items are deemed worthy of note. Module M-1, for example, which houses a garage and workshop may be produced without a floor frame, and positioned about a concrete slab located at ground level. Note further that module M-1 includes only the basic frame as illustrated in FIG. 1. Adjacent module M-2 includes a stairwell S in a corner of same which is produced as a separate subsection in similar fashion to the frame subsections, and is locateable on the floor of module M-2 extending upwardly into second floor module M-6 located directly above same (See FIG. 5). In order to accommodate stairwell S, an appropriate segment of the roof of module M-2 is eliminated, permitting stairwell S to extend therethrough. An appropriate matching segment of the floor of module M-6 is likewise eliminated, permitting stairwell S to pass therethrough. Once the modules are set, one atop the other, stairwell S is appropriately secured to the modules to ensure coplanarity of appropriate surfaces and the like.

Referring back to FIG. 4, it is seen that modules M-3 and M-4 are disposed in side-by-side location adjacent module M-2. The broken lines extending along the lengths of modules M-3 and M-4 represent the junction between same which would not be visible. The total space within the combined internal areas of modules M-3 and M-4 is fully open. Note further on FIG. 4, that module M-2 has a cantilever section at both ends of same, one cantilever section having the entranceway located thereon while the opposite cantilever section forms a portion of the kitchen. Modules M-3 and M-4, on the other hand, are provided with one cantilever section at one end which sections cooperate to form a patio. One can thus very readily observe the that modules produced according to the process of the present invention could be employed in many different floor plans, attesting to the extreme architectural flexibility of the coneept. In FIG. 5, the upstairs or second story modules M-5 and M-6 are shown, illustrating a typical living area for the dwelling. Modules M-5 and M-6 would be vertically stacked atop Modules M-1 and M-2 respectively, with both modules having a cantilever section at one end only. The cantilever section of module M-5 forms a balcony off the master bedroom while the cantilever section of module M-6 forms a portion of the second bedroom.

Figure 6:
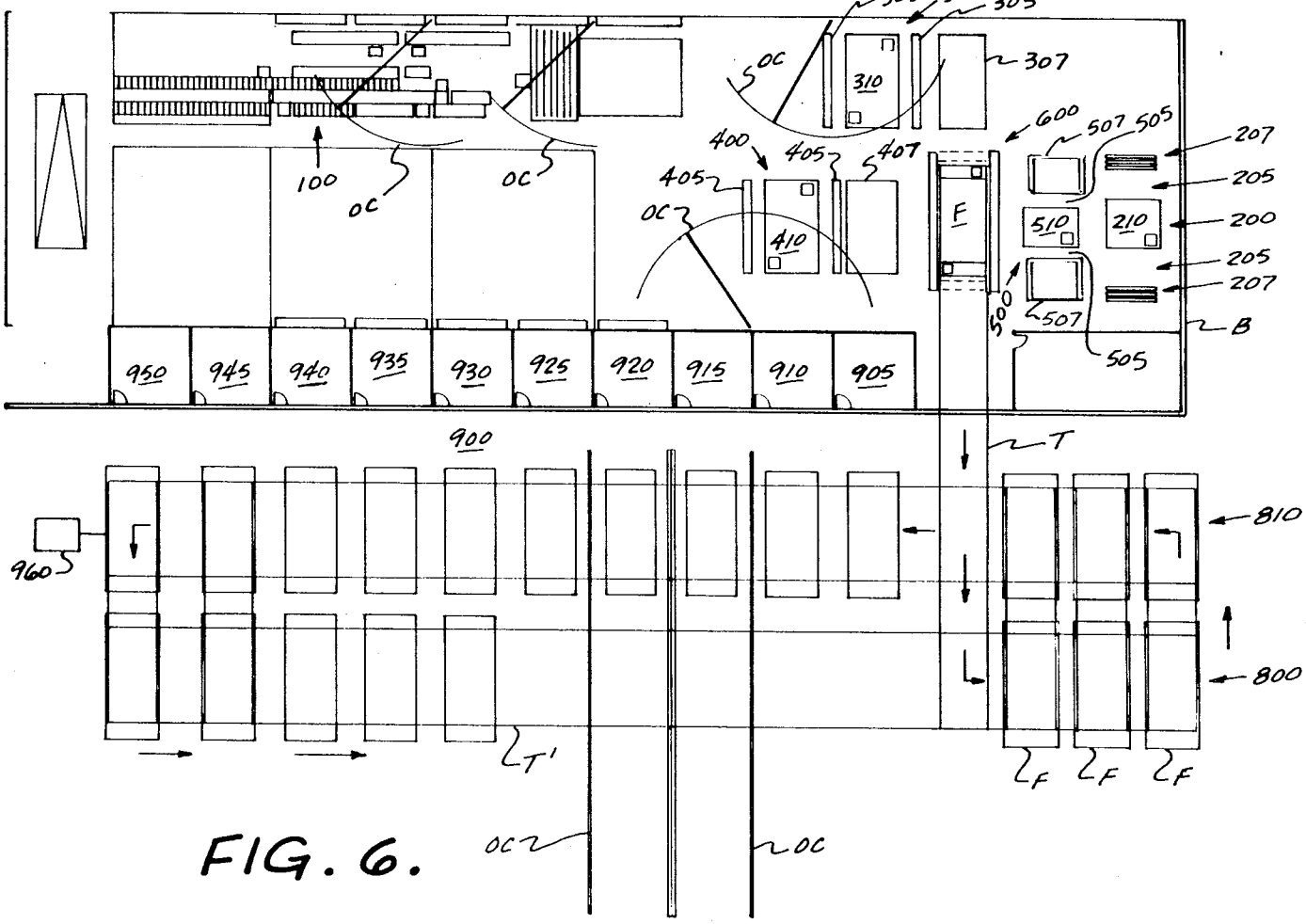
FIG. 6 is a plan view of a preferred factory layout for carrying out the process of the present invention.
Figure 7:
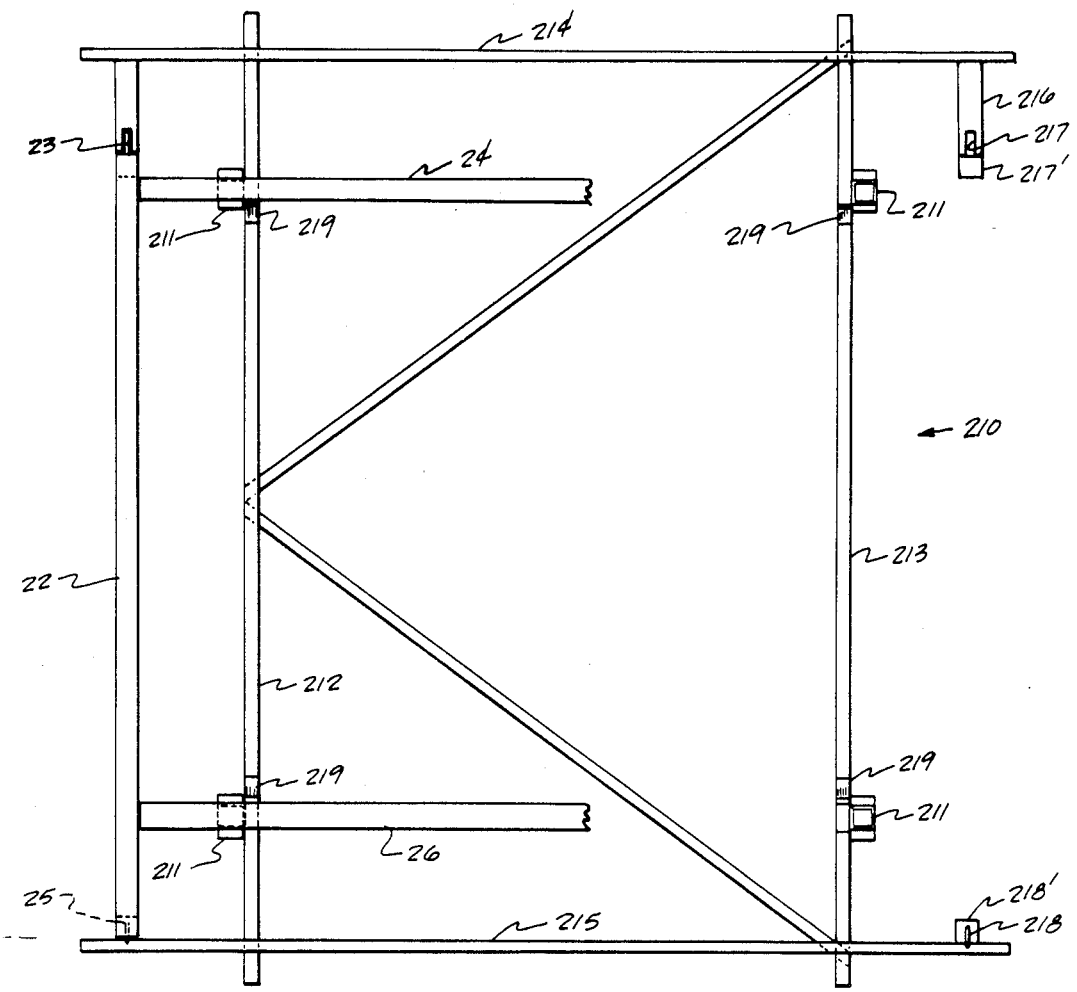
FIG. 7 is a plan view of a portal frame sub-assembly jig according to the present invention.
Figure 8:
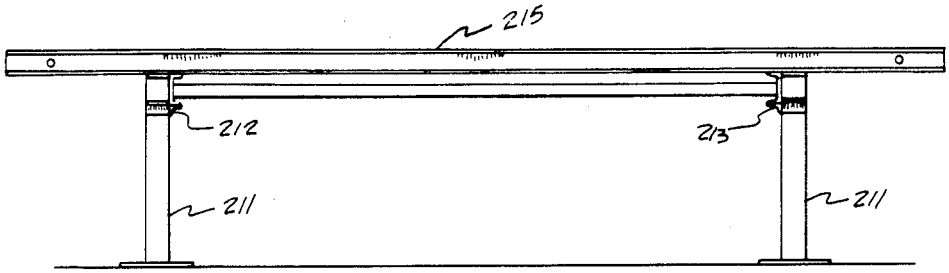
FIG. 8 is a side elevational view of the portal frame sub-assembly jig of FIG. 7.
Figure 9:
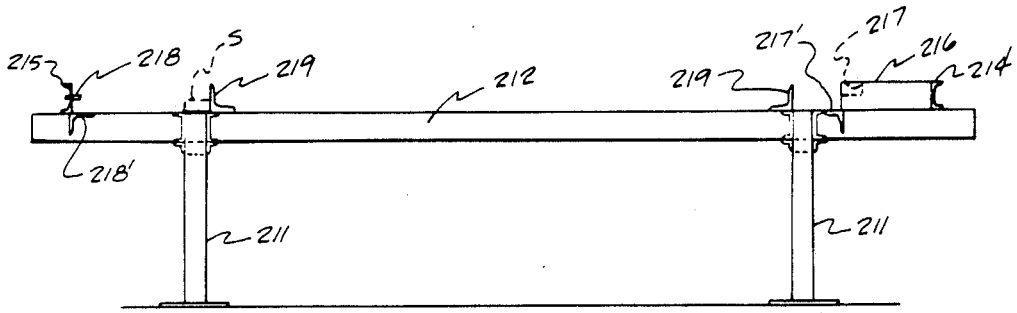
FIG. 9 is an end elevational view of the portal frame sub-assembly jig of FIG. 7.

Referring to FIG. 6, a preferred general plant layout for producing building modules according to teachings of the present invention will now be described in detail. As illustrated, fabrication of building modules originates within a building B for assembly of the module frame, after which the frame may be moved outwardly of building B for completion of the module. While such an arrangement is by far most economical due to the low capital requirements for buildings, obviously should weather conditions dictate, the entire procedure could be conducted within one or more buildings. A component preparation area generally indicated as 100 is located at one end of building B where the individual components for fabrication of the frame subsections, to be described hereinafter, are prepared. For example, open web trusses may be produced, the particular beams and columns may be cut to prescribed length, and the like. Once components for a particular subsection are available, they may be transported in any convenient way, such as by overhead cranes OC to a particular location where the components are assembled into the particular frame subsection. An opposite end of building B is devoted to assembly of the various frame subsections and final assembly of the module frame. An area generally indicated as 200 is provided for fabrication of portal frame subsections; an area indicated generally as 300 for the fabrication of the floor frame subsections; an area generally indicated as 400 for the fabrication of a roof subsections, and an area generally indicated as 500 for fabrication of cantilever section frame subsections. All of the subsection assembly sites are located about an area generally indicated as 600 which is the final assembly site for the frame. The various frame subsections are thus assembled in their respective areas after which they are moved in predetermined order by overhead crane to final assembly site 600 where with the use of appropriate jigs as will be described hereinafter, the module frame is fabricated. Preferably, other module features are added at the frame assembly site such as the reinforcing mesh for the concrete floor and the roof. Also, in a most preferred embodiment, appropriate formwork 100 for production of the monolithic concrete floor is removably secured to the frame at assembly site 600.

Once work at assembly site 600 is complete, transport means such as casters or the like are removably secured to the vertical columns of the portal frames to permit the assembled module frame F to be moved through remaining finishing stations. Preferably the casters are employed and are receivable on a trackway T. Following the arrows, it is seen that frame F is moved out of building B in a direction axial to the longitudinal axis of frame F. At the end of trackway T, frame F is moved in a direction transverse to its longitudinal axis to a concrete floor pouring station generally 800, where preferably a plurality of such frames are accumulated to be poured as a group. Directional changes in trackway T are accompanied by conventional switching means for the casters (not shown) whereby the module frame can be moved at right angles. Once an appropriate number of frames are located at pouring station 800, concrete is cast into the formwork of all of the frames and the upper surface of the concrete finished according to conventional techniques, preferably by power floating. Frames F with finished concrete floors are then moved along trackway T to a concrete curing station 810 where the frames remain for a period of time adequate to allow the concrete to cure to an appropriately hardened slab. Preferably at curing station 810, electric blankets are draped across the concrete floors to accelerate curing of the concrete, though quick curing concrete or other cure acceleration techniques may be employed.

Following curing of the concrete floor, the individual modules are moved along trackway T to a module finishing area generally 900 where a plurality of individual finishing stations are located side-by-side such that the desired particular finishing operations may be carried out thereat. According to a preferred arrangement, at a first station 905, the stud runners and studs that frame up the interior walls and the ceiling grid may be installed. Also at station 905, should loading on the module require same, diagonal bracing may be secured within the module frame F at particular areas around the perimeter of same. Normally, such diagonal bracing is not required for single story module use, though should a multiple story structure be designated, lower modules in a vertical stack arrangement may require the additional support. When further bracing of frame F is utilized, the bracing can be located and concealed around frame F to avoid interference with the architectural flexibility achieveable with the modules or aesthetics of the module.

At a second finishing station 910, with the interior walls framed in, basic electrical and plumbing lines, conduit, and the like may be installed and the vapor barrier, preferably a fabric-reinforced polyethylene sheet, may be secured about predetermined segments of the exterior of frame F according to the design for the particular module. At station 915, exterior cladding panels are then secured to the portion of frame F dictated by the module design. Preferably, the cladding panels are glass reinforced concrete panels that are produced with a predetermined exterior design, and would include the plain and special panels called for in the module design. At finishing station 920, insulation such as fiberglass may be installed above the ceiling and within the interior wall frames. Likewise air conditioning duct may be installed and insulated if desired. Once the walls are appropriately insulated, gypsum board or other type wall panels may be secured to one or both sides of the stud walls according to whether the wall is a peripheral wall or a partition wall. In a most preferred embodiment, the gypsum panels are employed and are secured to the wall studs with self-threading screws or the like. Additionally at station 920, additional glass reinforced or other type cladding panels may be secured to frame F, if needed. Overhead cranes OC are located adjacent finishing stations 915 and 920 to facilitate handling of the cladding panels and securement of same to frame F. Also, the overhead cranes OC are employed for lifting the finished modules from a return leg T' of trackway T and loading same on transit vehicles.

Further gypsum board panels may be installed, if needed, at finishing station 925, for walls or the ceiling and the facing surfaces of the wall boards and joints therebetween may be finished by the application of putty, taping, sanding or the like. Likewise in a preferred embodiment gypsum board panels and the joints therebetween are covered with a reinforcing medium such as a fiberglass fabric adhesively secured thereto, or a flexible polymer film that is produced in situ thereover. Both such reinforcing means secure the fastening means in place to preclude withdrawal of same during tranmit of the module to the building site and reinforce the panels against fracture.

Stations 930 and 935 are devoted to finishing of the interior of the module, and includes papering, painting or the like according to the module design. Exterior painting, if appropriate, would likewise be accomplished at stations 930 and 935. At station 940, the floor of the module may be finished by the securement of an appropriate floor covering such as carpet, tile or the like thereover, after which skirting boards and ceiling molding may be secured around the bottom and top of the interior walls. At station 945, further electrical components may be added such as light fixtures, switches, thermostats, stoves, water heaters, or the like. Other finishing as required may also be completed such as hanging doors. At station 950, plumbing fixtures may be set into place according to the plan.

At this point, the module is virtually complete and may be cleaned up for transport to the building site. The trackway at the end of station 950 make further turns, along which the finished modules may be moved and stored on return leg T', awaiting loading in vehicles for transport to the building site.

Techniques according to the present invention for fabricating portal frames 20 will now be described with reference to FIGS. 6 through 9. In FIG. 6, portal frame preparation site 200 includes sites generally 205 for storage of component materials and sites generally 207 for storage of completed portal frames 20, located on opposite sides of a jig assembly generally indicated as 210. Particular component parts for the portal frames 20 having been precut and otherwise prepared for assembly of the portal frame at jig 210 are stored at sites 205 and placed on the jig 210 as desired. Due to the particular construction of jig 210 as well as the other jigs described hereinafter, any deviation of a component part from the correct size or length will be readily apparent to an operator during assembly of the frame subsection. Jig 210 is skeletal in nature and is supported by four upstanding columns 211 to which are secured longitudinal struts 212 and 213. Longitudinal struts 212 and 213 are half I-beams with the flat side secured internally of vertical columns 211, with columns 211 being spaced inwardly from the outer opposite extremities of struts 212 and 213 by like amounts. Transverse struts 214 and 215 are secured atop longitudinal struts 212 and 213, being spaced apart by a predetermined amount. Transverse strut 214 has a pair of elements 216 secured thereto, extending inwardly therefrom in the direction of transverse strut 215, and spaced apart the exact distance to receive the portal frame columns 22. Elements 216 have the same cross section as columns 22, and define a slot 217 in an upper surface of an inner free end of same with a locator plate 217' secured therebelow. A pair of pins 218 are secured to transverse strut 215, opposite slots 217 and extend inwardly therefrom towards strut 214, with a locator plate 218' located therebeneath. Pins 218 are in exact alignment to receive the pin receiving openings 25 within a lower end of columns 22, while the connector pins 23 at upper ends of column 22 are received in slots 216. The operator can then visually ascertain that columns 22 are the appropriate size and length.

Longitudinal struts 212 and 213 have a pair of stops 219 secured to an upper surface of same with each opposite pair of stops 219 located at a predetermined position along struts 212 and 213 such that horizontal beams 24 and 26 of portal frames 20 may rest atop struts 212 and 213 and against stops 219 to properly position same with respect to columns 22. With two columns 22 received in jig 210, and horizontal beams 24 and 26 laid atop struts 212 and 213, an operator can visually determine that the beads contacting an inside surface of a column 22 at opposite ends of same are proper lengths. Moreover, for conventional portal frames, the horizontal beams 24 and 26 should be of a like cross-sectional dimension as that of columns 22 whereby an operator likewise may visually determine same. A spacer S is shown in phantom at one stop 219 in FIG. 9. Spacer S is used when it is desirable to reduce the size of one or both horizontal beams 24, 26 to accommodate a roof drain within the module end wall.

With a portal frame jig 210 as described above, an unskilled operator can very quickly place the component parts in the jig and visually observe that the proper size and length components are being employed. Thereafter the components may be welded or otherwise secured in a proper fashion. With the portal frames, as with the other structural frame subsection components, steel is preferred, whereby the method of securement is preferably welding. After the components are placed in the jig and welded at contacting locations, the completed portal frame 20 may be lifted from the jig, with connector pins 23 exiting the open top of slots 217 whereupon columns 22 may be moved off of pins 218 and plate 218'.

Figure 10:
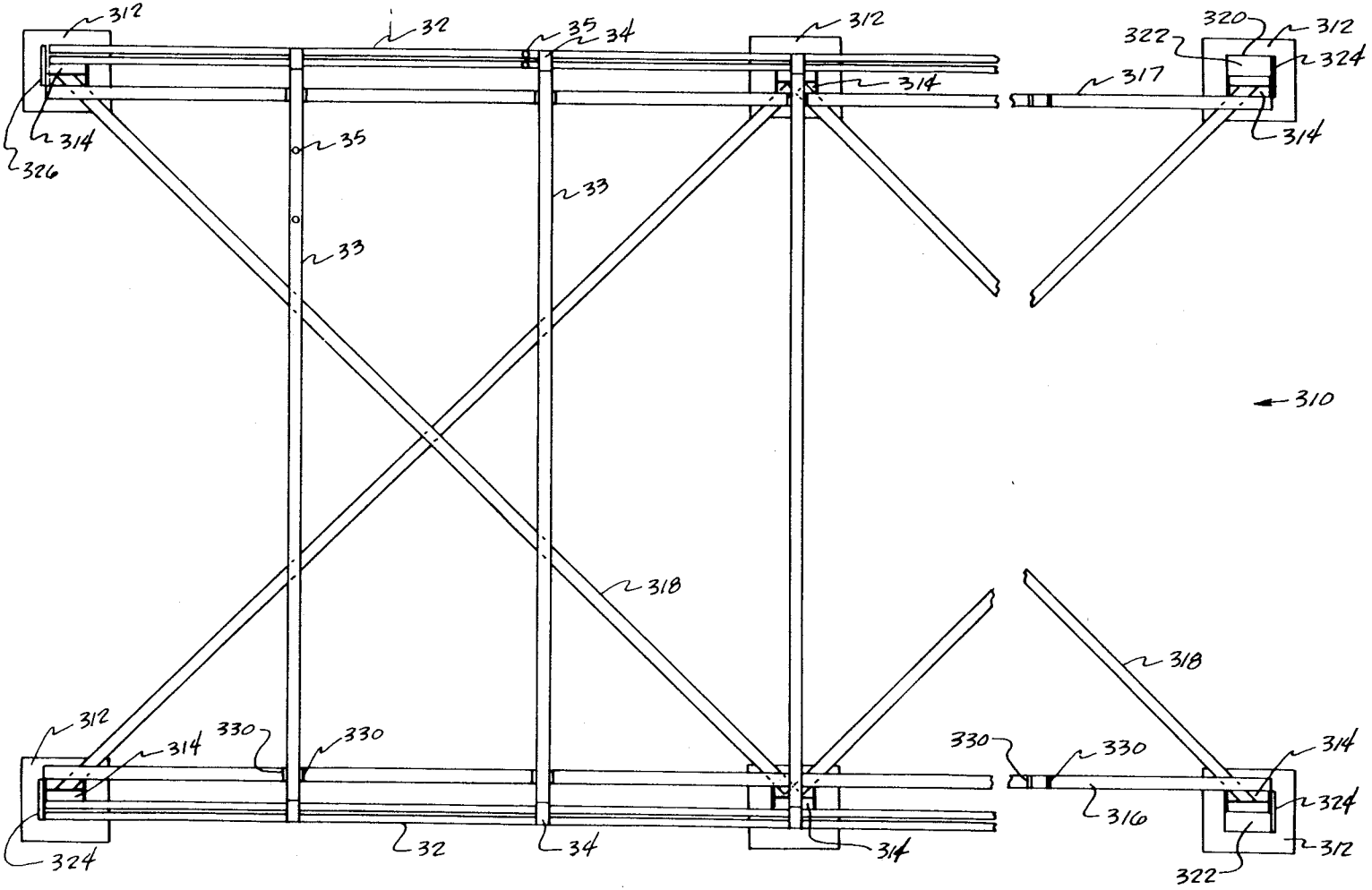
FIG. 10 is a plan view of a floor frame sub-assembly jig according to the present invention.
Figure 11:
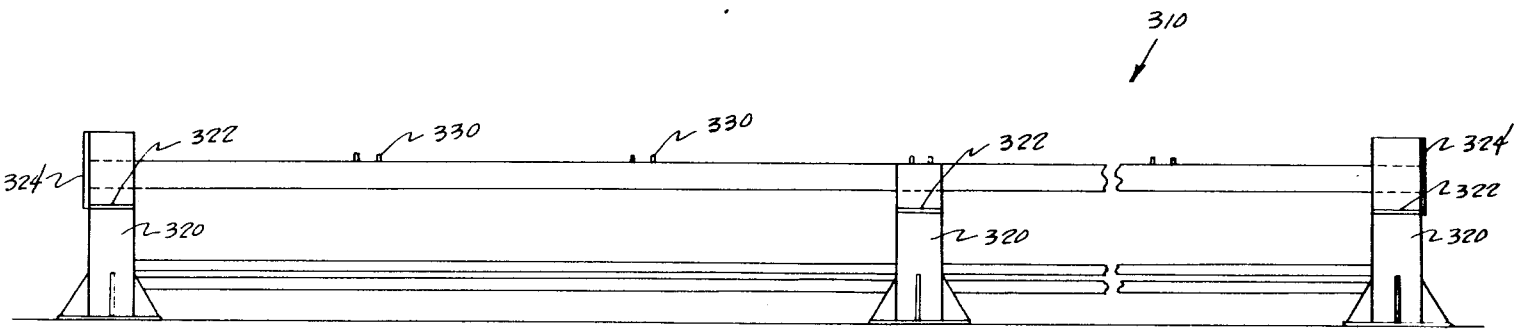
FIG. 11 is a side elevational view of the floor frame sub-assembly jig of FIG. 7.
Figure 12:
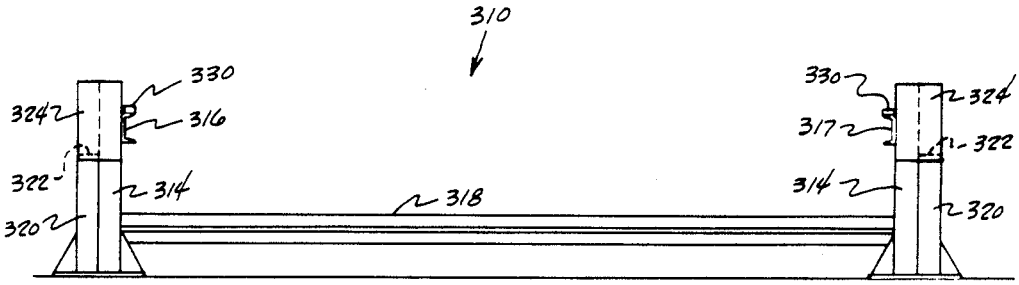
FIG. 12 is an end elevational view of the floor frame sub-assembly jig of FIG. 10.

Making reference to FIGS. 6, 10, 11 and 12, assembly of the floor frame subsection will now be described. As illustrated in FIG. 6, floor frame subsection jig 310 is located at assembly site 300, with component parts for same located at 305 and a storage area for assembled floor subsections at 307, on opposite sides from jig 310. In FIGS. 10 through 12, a jig 310 for assembly of a floor frame subsection is shown, having a plurality of base supports 312 located about the periphery of same with vertical supports 314, preferably in the form of I-beams, secured thereto and extending upwardly therefrom. A pair of longitudinal struts 316 and 317 are secured along the inside of vertical supports 314 a predetermined distance downwardly from an upper end of same, with a plurality of cross braces 318 secured between vertical supports 314 at a lower level. Each vertical support 314, (one at each end of jig 310 and at least one intermediate the length therebetween), has a short I-beam outside support 320 secured along an outer edge of same. I-beams 320 have a plate 322 secured to a top of same, with the distance from an upper surface of plates 322 to an upper edge of supports 314 defining the height of an open web truss 32 to be received thereat. An end plate 324 is secured across the width of vertical supports 314 and outside supports 320 at each end of jig 310, to cooperate with plates 322 and an outside surface of supports 314 above support 320 to define a receiving location for opposite ends of open web trusses 32. The width of outer support 320 and plate 322 define the proper thickness of open web truss 32, while the distance between the inner surfaces of opposite end plates 324 defines the proper length for open web trusses 32. An open web truss received between plates 324 on a single side of jig 310, and resting on plates 322 at opposite ends and intermediate the length of same, may be easily ascertained as having the correct thickness, height and length.

Located along the length of longitudinal struts 316 and 317 are a plurality of pairs of upstanding elements 330. Pairs of elements 330 are located at predetermined locations along the length of the respective struts 316 and 317, with elements 330 in each pair being spaced apart to properly receive floor purlins 33 therebetween. Elements 330 have a height equal to the proper thickness of floor purlins 33, whereby when a floor purlin is laid across struts 316 and 317 and is received within opposite pairs of spacer elements 330, the proper width and thickness of same may be ascertained. As pointed out hereinbefore, floor purlins 33 are secured to open web trusses 32 by way of L-shaped brackets 34, one leg of which is secured to an end of purlin 33 with the other leg extending outwardly therefrom to be received atop open web truss 32. Accordingly, in preparation of the floor purlin components 33, the mounting brackets 34 would be welded to opposite ends of same, whereby once the floor purlins 33 with brackets attached thereto are placed atop struts 316 and 317 within the opposite pairs of spacer elements 330, the outwardly extending leg of brackets 34 will reside atop open web trusses 32 for proper securement thereto. In like fashion, since open web trusses 32 and floor purlins 33 will have a plurality of floor reinforcing elements or shear connectors 35 secured thereto and extending upwardly therefrom, such could likewise be added in the component preparation stage, or if more advantageous, at the final frame assembly site. Once the elements are placed in jig 310, proper dimensions of open web trusses 32 and floor purlins 33 may be immediately ascertained, and the components welded to form the floor frame subsection. Thereafter the frame may be lifted by an overhead crane and stored in the floor frame subsection area 307 awaiting transfer to the final assembly point 600.

Figure 13:
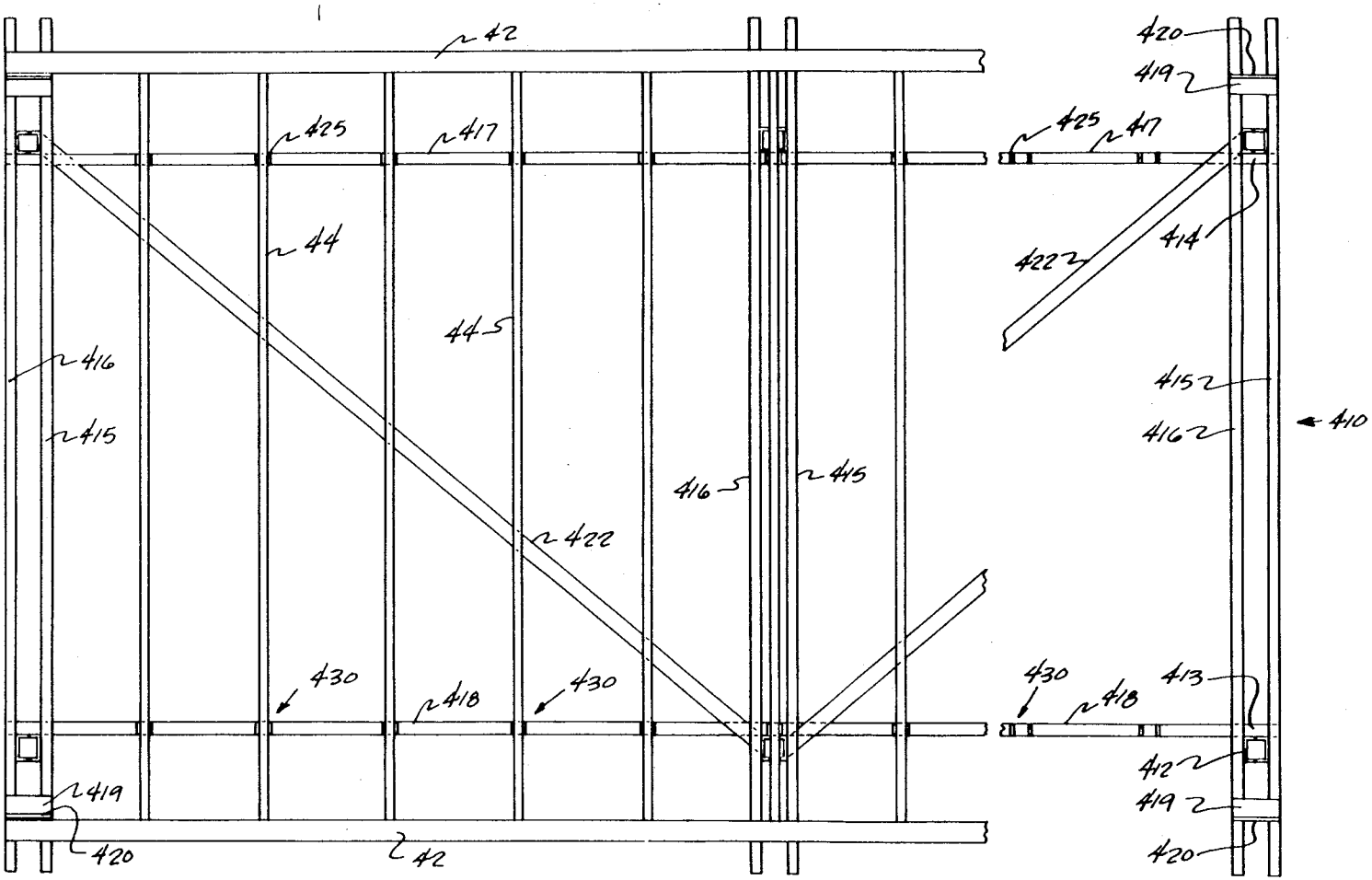
FIG. 13 is a plan view of a roof frame sub-assembly jig according to the present invention.
Figure 14:
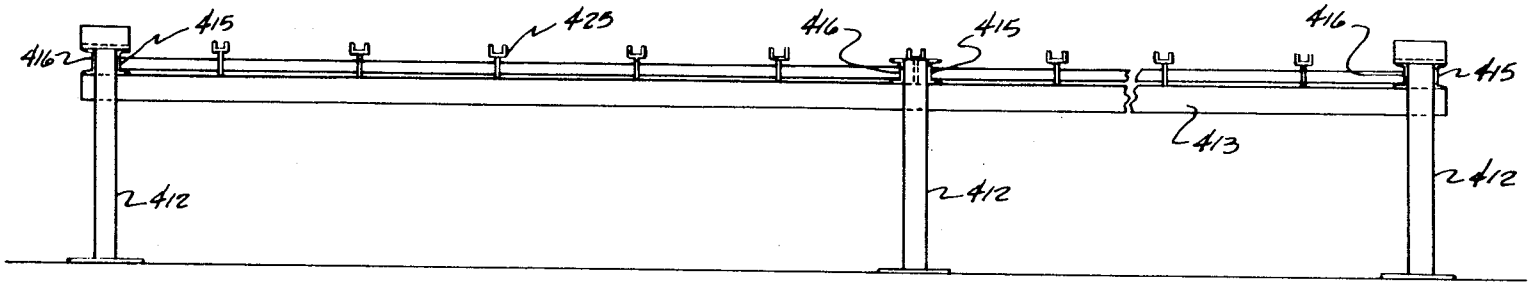
FIG. 14 is a side elevational view of the roof frame sub-assembly jig of FIG. 13.
Figure 15:
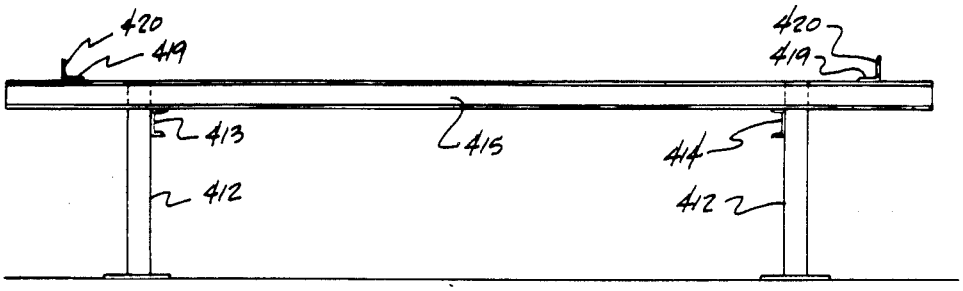
FIG. 15 is an end elevational view of the roof frame sub-assembly jig of FIG. 13.
Figure 16:
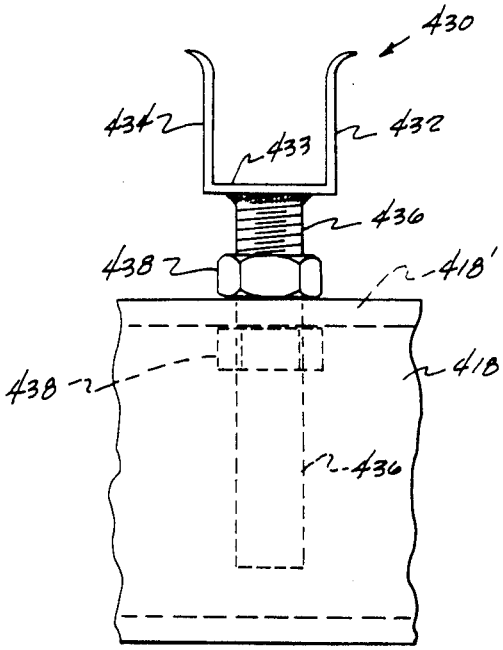
FIG. 16 is a side elevational view of an adjustable jig for roof purlin placement.
Figure 17:
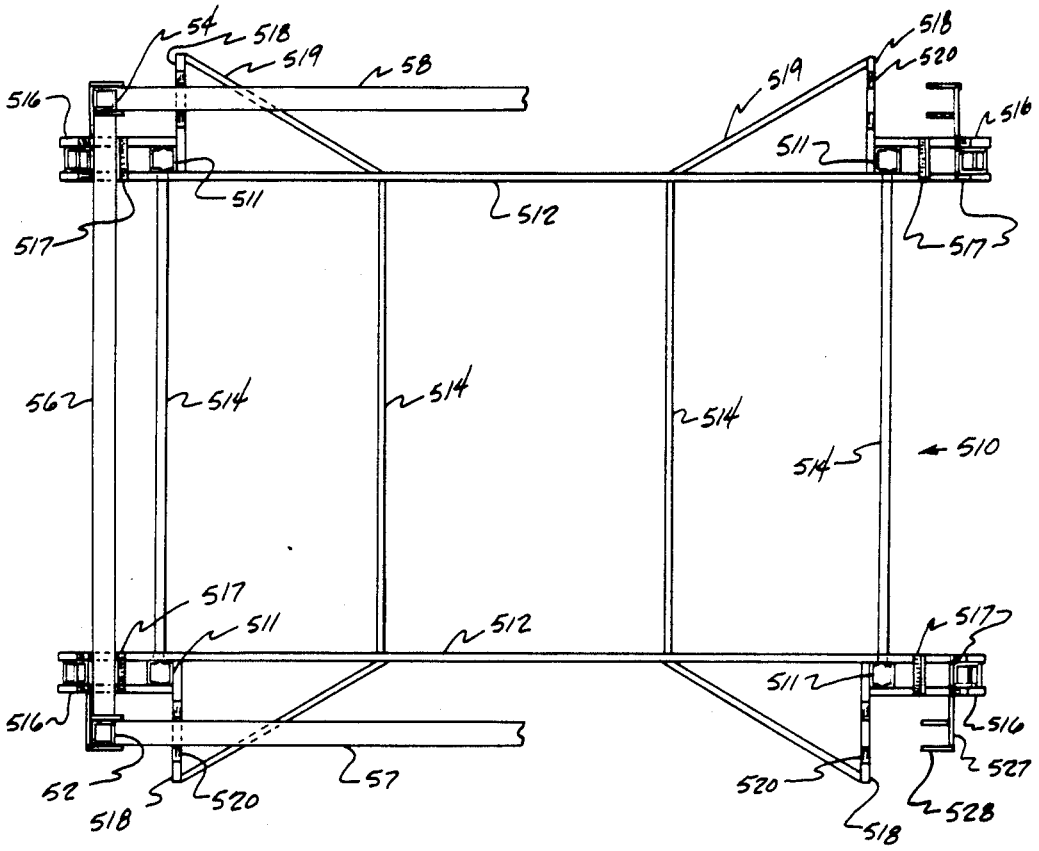
FIG. 17 is a plan view of a cantilever section frame sub-assembly jig according to the present invention.

Assembly for the roof frame subsection 40 will now be described with respect to FIGS. 6 and 13 through 16. Roof frame subsections are assembled at site 400 which includes component storage site 405, a jig 410, and a storage area 407 for assembled roof frame subsections 40. Referring to FIGS. 13 through 16, jig 410 is illustrated for receipt of the components for the roof frame subsection where, again, the individual components may be visually checked for size and length, and may be appropriately secured to produce the desired frame subassembly 40. Roof frame jig 410 includes a plurality of vertical supports 412, preferably three on each side of same to which longitudinal support struts 413 and 414 are secured along an inner side, inwardly from an upper end of same. Located atop horizontal struts 413 and 414 and on opposite sides of vertical supports 412 are a plurality of pairs of transverse struts 415 and 416, both of which are U-shaped beams with the flat sides of same secured against the respective vertical supports 412, and with transverse struts 415 and 416 extending outwardly beyond vertical supports 412. Secured within the opposite inner spaces of the adjacent horizontal transverse struts 415 and 416, and above longitudinal support struts 413 and 414 are a further plurality of longitudinal horizontal members 417 and 418, likewise preferably U-shaped beams positioned with the flat sides of same facing outwardly. Crossing supports struts 422 may be secured between diagonally opposite vertical supports 412, or otherwise as appropriate. Two L-shaped brackets 419 are secured atop at least end struts 415 and 416, adjacent but inwardly from opposite ends of same. Brackets 419 have a vertical leg 420 whose height is equal to the height of tubular beams 42 of roof frame 40, and are so located that outer vertical legs 420 of same receive longitudinal tubular beams 42 in contact therewith. As can be seen in FIG. 13, a longitudinal beam 42 placed atop struts 415 and 416 and against the vertical leg 420 of L-shaped brackets 419 may be properly determined as to length by the outer extremities of the end of jig 410 and as to height by the height of the leg 420 of bracket 419.

Longitudinal struts 417 have a plurality of bifurcated members 425 secured thereto to receive roof purlins 44 therewithin. The space between the bifurcated legs of receiving element 425 is such that the proper width dimension of the purlins 44 may be ascertained. On the opposite side of jig 410 and along longitudinal struts 418, a plurality of adjustable, bifurcated elements generally indicated as 430 are received (See FIG. 16) for receiving an opposite end of roof purlins 44.

Adjustable bifurcated elements 430 include spaced apart legs 432 and 434 that extend upwardly from a base 433. A threaded element 436 is secured to an underside of base 433 and extends downwardly therefrom. Struts 418, as mentioned above, are U-shaped beams, with flanges 418' extending inwardly of jig 410. Top flange 418' defines a plurality of openings therealong through which threaded elements 436 of bifurcated elements 430 pass. A pair of locking nuts 438 are located above and below top flange 418' of strut 418, such that the height of bottom plate 433 of bifurcated elements 430 may be adjusted upwardly or downwardly as desired. While all of the bifurcated elements 425 along longitudinal struts 417 are standard as to height, bifurcated elements 430 are individually adjustable, whereby the slope of individual purlins 44 may be varied along the length of roof frame subsection 40. Hence when a roof is applied to the roof frame 40, planar sheets 46 that are secured to roof purlins 44 will follow the slope of the purlins and define a like slope for the module roof. Preferably, the roof will slope entirely from one side to the other and from a medial portion of a lower side outwardly toward opposite ends.

Utilizing jig 410, elongated tubular beams 42 may be placed thereon, residing on struts 415 and 416 with dimensions of same determined as noted above. Thereafter roof purlins 44 are positioned between the elongated beams 42, within opposite bifurcated elements 425 and 430, respectively. Cross sectional size of purlins 44 may be compared to dimensions of elements 425, 430 while length of the purlins will be ascertained at the juncture with elongated tubular beams 42. Once the components are placed within the jig and appropriately welded or otherwise secured, the roof frame subsection may be lifted by an overhead crane and placed at storage site 407, awaiting transfer to the final frame assembly site 600.

Referring to FIGS. 6 and 17 through 19, cantilever frames 50 are fabricated at assembly site 500 where component storage sites 505 and a cantilever frame subsection storage sites 507 are located adjacent assembly jig 510. Jig 510 includes four vertical support members 511 which are rectangular tubular members to which longitudinal struts 512 are secured along an inside surface of same, extending outwardly beyond supports 511 at both ends. A plurality of transverse struts 514 are secured between longitudinal struts 512. A short longitudinal extending strut 516 is secured to an outside surface of vertical supports 511, extending outwardly therefrom with respect to jig 510, parallel to longitudinal struts 512. A pair of L-shaped bracket spacers 517 are secured at predetermined locations along the outwardly extending portions of struts 512 and 516, having an upstanding leg facing inwardly, such that the vertical columns 56 of the cantilever frame subsection 50 may be received therebetween, extending across the width of jig 510 and beyond. Short transversely extending struts 518 are secured to longitudinal struts 512, vertical columns 511 and longitudinal struts 516, and extend outwardly therebeyond, An angular brace 519 is secured between an outer free end of same and an outer edge of longitudinal struts 512. Each short transverse strut 518 has a pair of L-shaped bracket spacer elements 520 secured thereto with vertical legs of same located inwardly, such that the space therebetween defines a receiving area for upper and lower cantilever transverse tubular beams 57 and 58.

Figure 18:
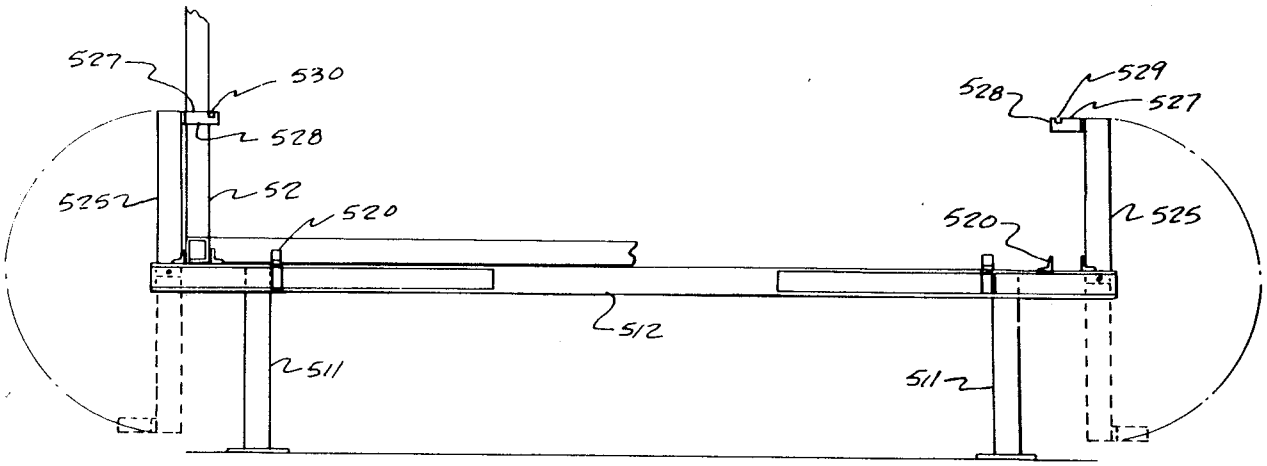
FIG. 18 is a side elevational view of the cantilever section frame sub-assembly jig of FIG. 17.
Figure 19:
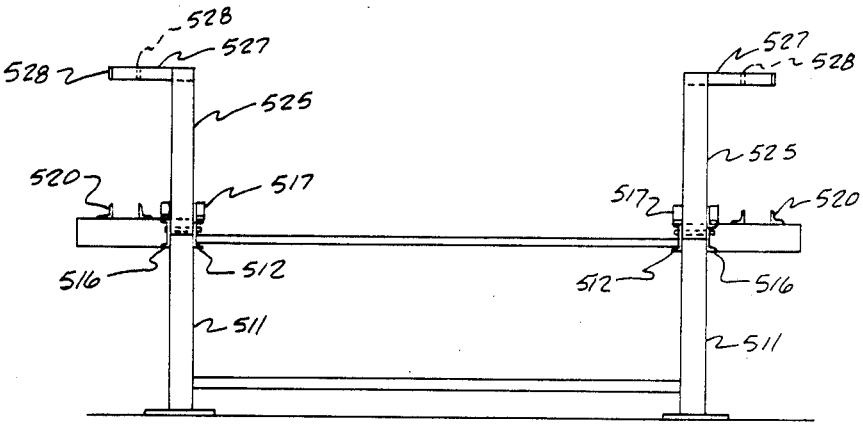
FIG. 19 is an end elevational view of the cantilever section frame sub-assembly jig of FIG. 17.

A support 525 is pivotally secured between the outer end portions of parallel longitudinal struts 512 and 516 and has an arm 527 extending transversely outwardly therefrom. An outer end of arm 527 is provided with a pair of spacer elements 528 that are so located that the space therebetween is appropriate for receiving longitudinal horizontal cantilever beams 52 and 54 therewithin. Moreover, spacer elements 528 are provided with a notch 529 into which a bar 530 may be received when tubular elements 52 or 54 are received within spacer elements 528, to hold same appropriately in place. As shown in FIG. 18, pivotal supports 525 will reside beneath jig 510 when not in use.

With supports 525 beneath jig 510, cantilever columns 56 are placed within spacer elements 517 at opposite ends of the jig (only one shown). Thereafter, beams 57 and 58 may be received within spacer elements 520 located on struts 518, such that again, the appropriate beam sizes of 56, 57 and 58 may be determined by the dimensions of the respective spacer elements and with the appropriate lengths of the components determined by the mating relationships between same. In this regard, beams 57 and 58 should mate with the outer extremities of cantilever columns 56. Once the four beams are in place, weldments may be produced at the junctions of same. Thereafter, the four supports 525 are pivoted upwardly above jig 510 and longitudinal beams 52 and 54 are placed within respective spacers 528. The appropriate size of beams 52 and 54 is determined by the dimensions of spacer elements 528 with the bar 530 located within notch 529, while a lower end of same will reside in proper contact with cantilever columns 56. With the beams 52 and 54 so located, weldments are produced at the junction between same and columns 56. Thereafter, bars 530 are removed, supports 525 pivoted to their inactive locations beneath jig 510, and the cantilever frame subsection 50 may be removed from jig 510 and appropriately located at storage site 507 awaiting transfer to the final frame assembly site 600.

Each of the frame subassemblies and the manner of fabricating same has been described above. With the frame subsections located in the appropriate storage sites, the module frame may now be finished. Making reference to FIGS. 6, 20 through 23, final assembly of a module frame will be described. Appropriate longitudinal final assembly jigs generally indicated as 610 are located along opposite sides of frame assembly site 600 with a pair of spaced apart rails R therebetween which make up trackway T. Each final assembly jig 610 includes a pair of spaced apart base plates 611 having I-beams 612 secured thereto and extending upwardly therefrom. A pair of half I-beams 614 and 616 are secured to opposite flanges of vertical support I-beams 612 with a plurality of crossing support struts 618 and 619 secured therebetween defining a catwalk along the length of both sides of the final assembly site. As illustrated in FIG. 21, an appropriate hand rail system 620 may be located on the rear side of the catwalks for safety purposes. A plurality of pivotal support beans generally 630 and 640 are associated with inwardly facing beams 616, of each jig 610, both of which are manually pivotable from an inoperative to an operative position. In an operative position, support means 630 engage a portion of the portal frames to maintain same in a proper vertical attitude while support means 640 engage a portion of the roof frame subsystem 40 as will be described in more detail hereinafter.

A pair of pits generally 650 are located in the floor at site 600, between jigs 610. Each pit 650 houses a hydraulic jack system 655 which may be raised or lowered, and which has a support framework 657 secured to an upper end of same and extending outwardly in opposite directions therefrom. Support framework 657 has a plurality of arms 659 pivotally secured thereto for storage within frame 657 as shown in phantom, and for pivotal movement without frame 657 where support spacers 662 may be presented beneath a portion of the portal frame subsection 20 for lifting of the frame after final assembly.

Figure 23:
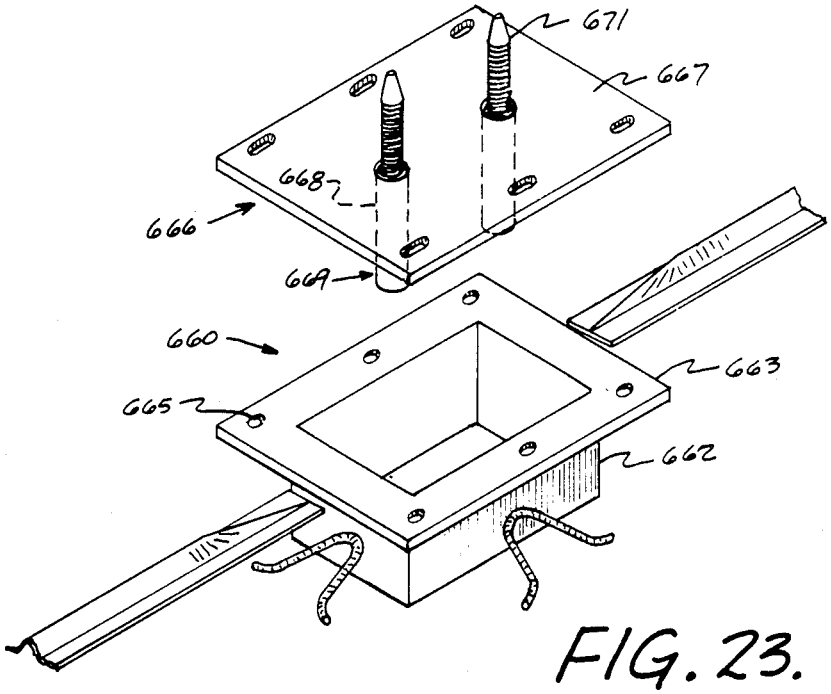
FIG. 23 is an exploded isometric view of a floor pin assembly for receiving portal frames at the final assembly site.

Rails R are interrupted at predetermined locations along final assembly site 600 to receive mounting pin assemblies generally 660 thereat (See FIG. 23).

Pin assemblies 660 are received along rails R to properly locate the portal frames 20, and include a housing 662 received within the floor and having a flange 663 secured to an upper end of same. Flange 663 has a plurality of openings 664 therein through which bolts 665 pass. An upper plate 666 is receivable atop flange 664 and has a plurality of adjustment slots therein corresponding to openings 664 in flange 663. Plate 666 defines a pair of openings 667, 668, each of which has a tubular support sleeve 669 secured around an underside of same and extending into housing 662. A mounting pin 671 is removably secured in opening 667 or 668. With pin assemblies precisely located, portal frames 20 may be placed thereover with mounting pins 671 residing within pin receiving openings 25 in the bottom of columns 22. The two openings 667, 668 permit the manufacture of a basic frame (placing pins in openings 668) on an extended frame (placing pins in opening 667).

With jack 655 in a recessed position as shown in phantom in FIG. 21, a portal frame 20 is brought to final assembly site 600 and vertical columns 22 are located atop mounting pins 671 which extend into the receiving areas 25 located in a lower end of same. Adjacent support beans 630 on final assembly jig 610 are then pivoted forwardly to an operative position. Support means 630 includes an arm 632 which is secured within a housing 631 for pivotal movement. A plate 634 secured atop arm 632 defines a slot 636 therein. In the operative position, slot 636 will mate with connector pin 23 of vertical column 22, such that the portal frame 20 is maintained in a proper vertical alignment. With one portal frame 20 so positioned, a floor frame subsection 30 is transferred by the overhead crane OC from the frame subsection storage site 307 to final assembly site 600. Floor subsection 30 is lowered into position adjacent portal frame 20 while jacks 655 are raised from within pits 650 and arms 659 pivoted outwardly of framework 657. Cups 662 will receive floor purlins 33 therewithin to support floor subsection 30 at a proper level. The opposite portal frame 20 is then brought into position at an end of floor subsection 30 in like ranner as with the first portal frame 20. As shown in FIG. 1A, there is generally an upward bow in floor frame subsection 30, such that when trusses 32 come into contact with columns 22, one bracket 22' with flange 22'' extending into an end of truss 32, a gap G remains between columns 22 and a lower edge of trusses 32. Initial weldments are thus produced only along the upper area of open web trusses 32. When the concrete floor is poured as shown in phantom, the bow is removed, gap G disappears and further weldment of trusses 32 to columns 22 may be produced along the lower edges of trusses 32.

After both portal frames 20 and floor subsection 30 are in place, roof frame subsection 40 is lifted by the overhead crane, brought to the final assembly site 600 and lowered for proper positioning. Roof frame support means 640 are pivoted inwardly to an operative position from final assembly jigs 610, where L-shaped brackets 646 or the like that secured to an arm 642 are located to receive longitudinal extending tubular roof beams 42 therein. The roof frame support subsystem 40 is thus supported at four locations, and is properly positioned for securement to the portal frames 20. With roof subsection 40 so positioned, weldments or other suitable securement means may then be provided at the juncture between the longitudinal tubular beams 42 and the inner surfaces of the vertical columns 22 of the portal frames 20. Once the frame subsections are secured as described above, the basic frame is assembled.

Should cantilever frame subsections 50 be employed, same are secured to the outer ends of one or both portal frames 20 as dictated by the module design. Particularly, jig elements generally 650 are received on jigs 610 at opposite ends of same to receive cantilever sections 50 (See FIG. 20). Jig elements 650 are of like construction as jig elements 640 and are pivotal into and out of a supporting position. As illustrated, jig elements 650 are properly located to receive longitudinal beams 52 of cantilever section 50 forward of the center of gravity of the frame whereby a lower portion of the cantilever frame turns about jig element 650 into proper positional contact with columns 22 for weldment. Alternatively, though not shown, cantilever section 50 could be otherwise supported by a plurality of jig elements on jig 610.

While at the assembly site, a forming framework 100 such as is generally illustrated in FIG. 1 may be removably secured to frame F for subsequent in situ production of the monolithic concrete reinforced floor. Forming pouring formwork 100 is only schematically illustrated in FIG. 1, and may take any suitable shape or configuration consistent with the production of the floor. A preferred formwork is described and claimed in copending application Ser. No. 06/504,362, entitled "Prefabricated Transportable Concrete Floor System and Method for Producing Same", filed concurrently herewith, the subject matter of which is incorporated herein by reference. Preferably elements of the formwork are located at assembly site 600 prior to transfer of floor subsection 30, whereby the elements may be lifted from beneath floor subsection 30 after completion of frame F and removably secured thereto. With the appropriate formwork secured about the floor of module frame F, the floor reinforcing mesh 36 may be laid atop the floor frame, with the shear connectors 35 passing through the interstices of same. Spacers may be provided between the formwork and an underside of mesh 36 to ensure total encapsulation of mesh 36 within the concrete floor to be produced. Likewise, with the frame assembled, the subroof sheets 46 of plywood or the like may be placed atop the roof purlins 44 and secured thereto, with the junction between sheets 46 being adhesively secured to form a unified subroof structure. Thereafter, an appropriate waterproof barrier may be applied across the subroof sheets 46 and secured thereto by heat welding, or the like. In this fashion, the module frame is roofed such that the frame may then be moved without the building for completion.

Figure 20:
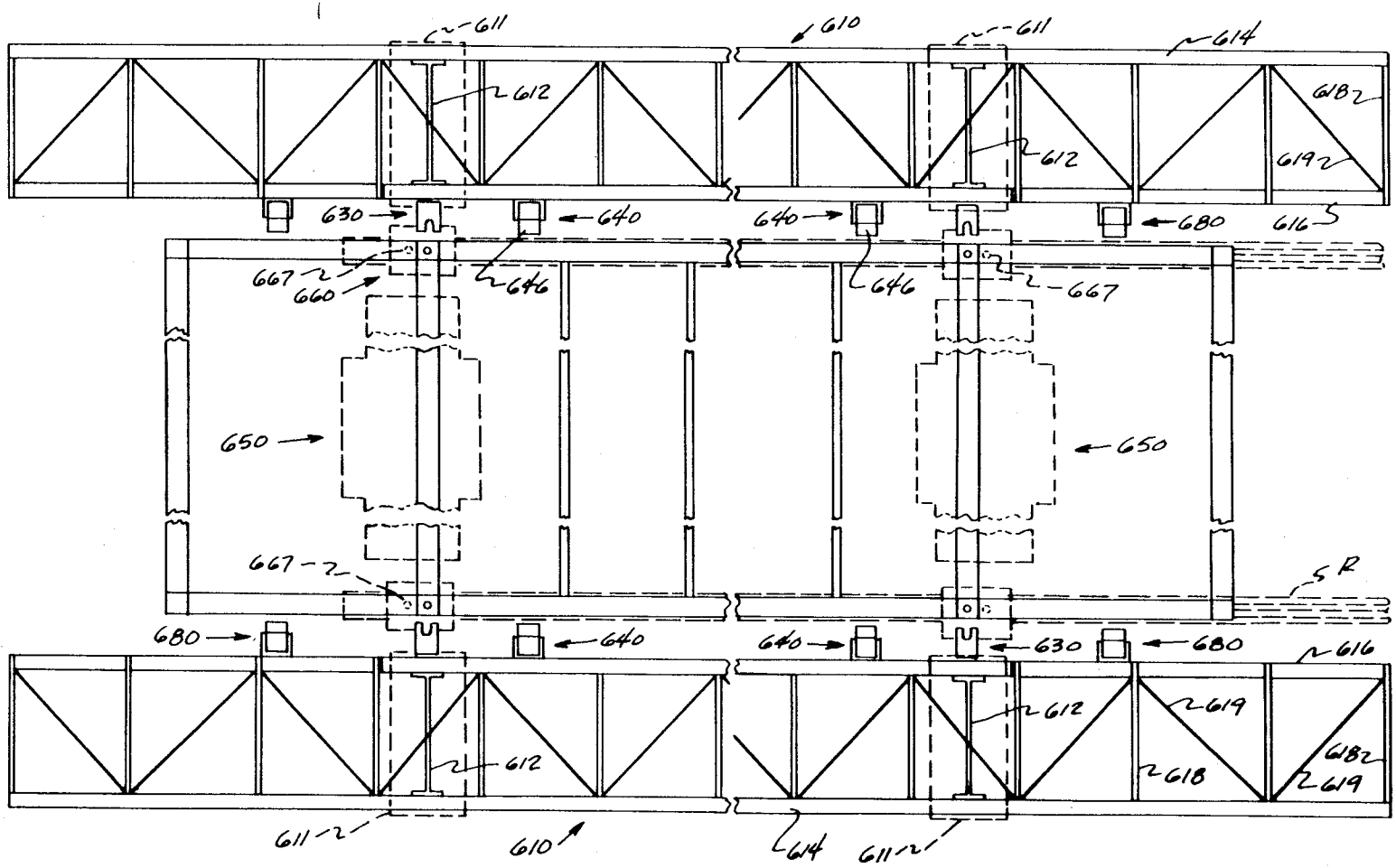
FIG. 20 is a plan view of final frame assembly jigs according to the present invention, illustrating partial placement of frame subsections.
Figure 21:
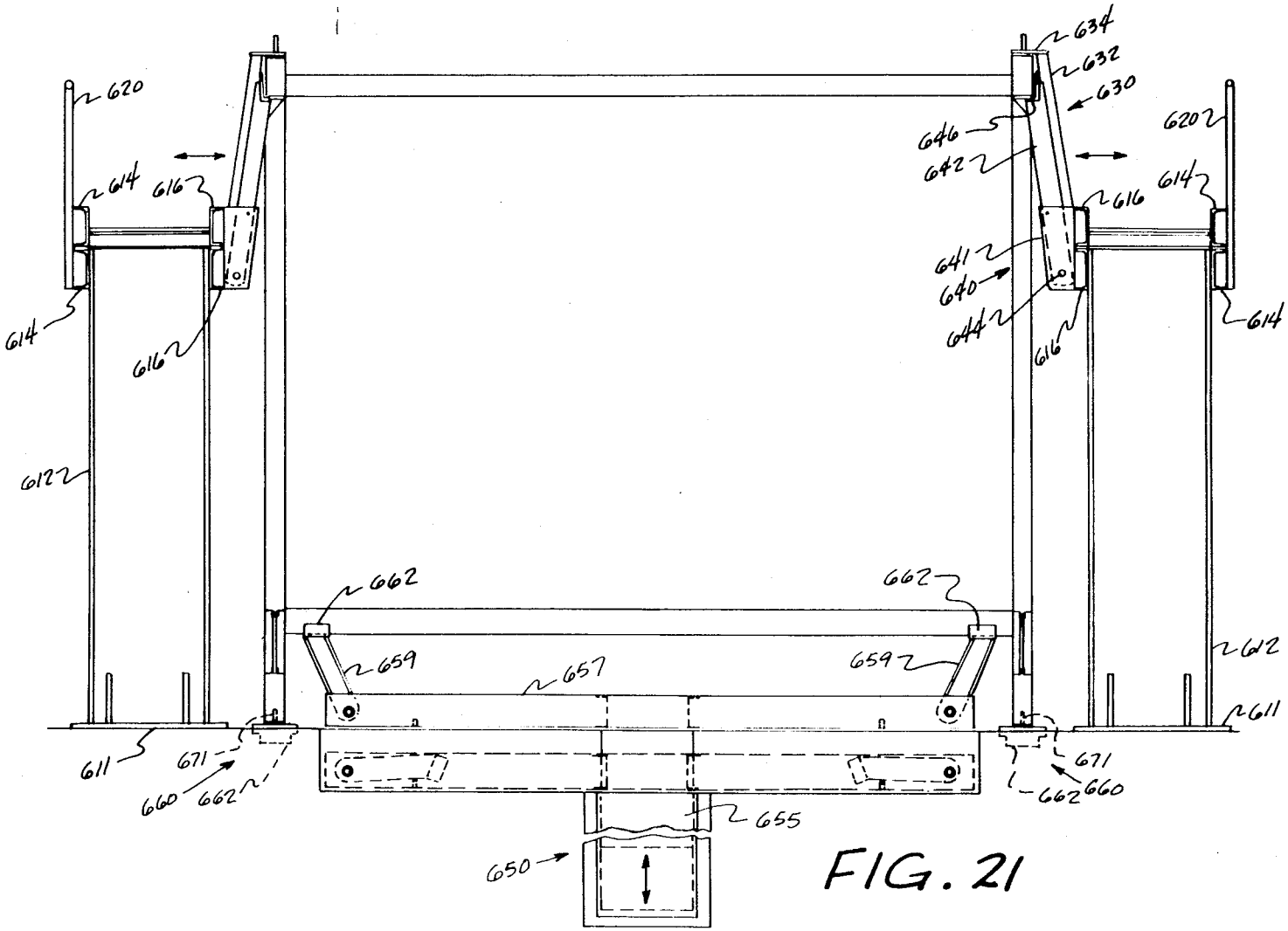
FIG. 21 is an end elevational view of the final frame assembly jigs of FIG. 20.
Figure 22:
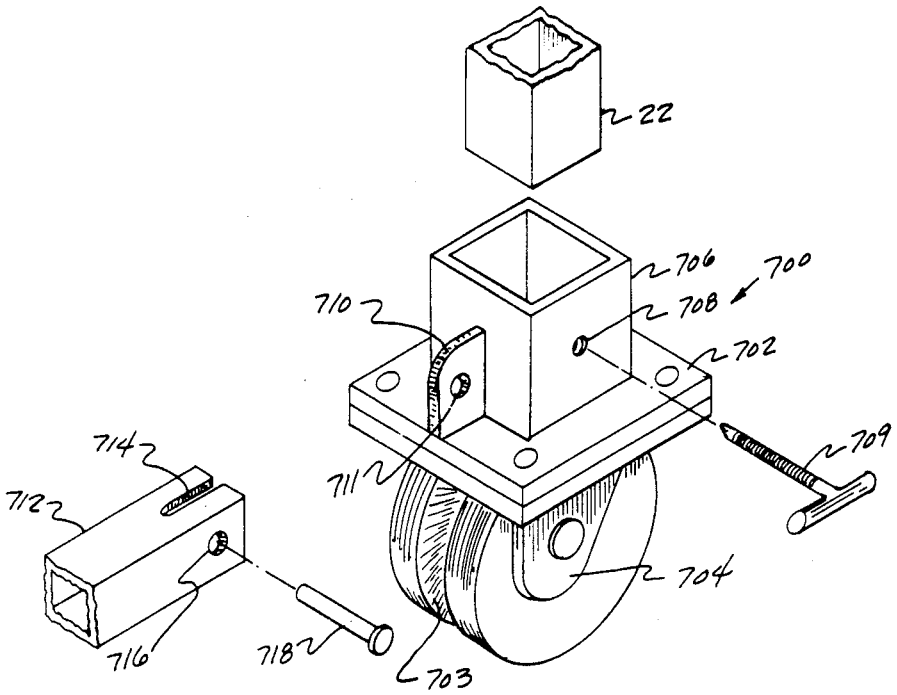
FIG. 22 is an isometric view of a roller means useable in the process of the present invention.

As shown in FIGS. 20 and 22, a pair of rails R are provided that make up a trackway T on which module frame F may be transported through the module finishing process. A caster assembly generally indicated as 700 is provided, adapted to reside over rail R. Roller neans assembly 700 is a preferred transport means according to the present invention and includes a support body 702 to which a wheel element 704 is secured for rotation about a horizontal and a vertical axis. Support body 702 has a tubular section 706 secured to an upper side of same, within which a lower end of a portal frame column 22 may be received. One or more threaded openings 708 are defined in a side wall of tubular section 706 into which a threaded element 709 is receivable to frictionally secure column 22 therewithin. A connector bracket 710 is secured between body 702 and tubular section 706 and defines an opening 711 therein. If desirable, a connector rod 712 may be provided having a slot 714 in opposite ends of same (only one being shown) into which connector bracket 710 may be received. An opening 716 is provided at slots 714 which will mate with bracket opening 711 when rod 712 is located about bracket 710, and a pin 718 may be passed therethrough to unite rod 712 and transport means 700. In this fashion, a plurality of module frames may be united for simultaneous movement by a common power source. Connection of modules by connector rods 712 preferably takes place along the straight portion of trackway T in front of finishing stations 905 through 950 (See FIG. 6). The distance between adjacent connected modules is equivalent to the distance between finishing stations whereby proper location of the lead module properly locates all the modules in the train. A power source 960 such as a power winch is located beyond finishing station 950 and may move the connected train of modules. When a module leaves station 950, it is disconnected from the train and moved independently to return leg T' where it is stored, awaiting transit to the building site.

In order to install transport means 700, jacks 655 are extended slightly, and jig elements 630, 640, and 650 if utilized are pivoted away from frame F. Jacks 655 are then extended further lifting frame F adequate to clear pins 671 which are then removed from the opening 668 or 669, and units 700 are secured to columns 22. Frame F is then lowered with caster wheels 704 positioned on plate 666 for movement onto rails R.

Having described the present invention in detail, it is obvious that one skilled in the art will be able to make variations and modifications thereto without departing from the scope of the invention. Accordingly, the scope of the present invention should be determined only by the claims appended hereto.

That which is claimed is:

1. A process for producing a building module comprising the steps of:

(a) fabricating a pair of skeletal portal frame subsections, a skeletal floor frame subsection and a skeletal roof frame subsection;

(b) positioning said frame subsections at predetermined locations at a final frame assembly site and bringing jigs for each subsection and such subsection into engagement to properly locate and support said subsection at a proper attitude with respect to said other subsections for frame assembly;

(c) securing said roof and floor frame subsections to said portal frame subsections while said jigs are in engagement therewith to construct a skeletal module frame;

(d) raising jigs for said floor frame to raise said module frame, removing said jigs for said portal frames and said roof frame, removably securing trackway roller means to said module frame and lowering said floor frame jigs to locate said trackway roller means on a trackway for said module and remove said floor frame jigs;

(e) moving said module frame along said trackway to a floor station and producing a monolithic reinforced concrete floor in situ on said floor frame of said module thereat; and (f) moving said module frame along said trackway past a plurality of further stations and finishing a predetermined portion of said module at each station so that the modular is virtually complete when it is moved away from the last of said stations and ready for transit to a building site.

2. The process as defined in claim 1 wherein the skeletal module frame is comprised of metal components welded together into a unified frame structure.

3. The process as defined in claim 1 wherein the sequence of positioning of said frame subsections is a first portal frame subsection, the floor frame subsection, an opposite end portal frame subsection, and the roof frame subsection.

4. The process as defined in claim 3 wherein the floor frame subsection has an upward bow therein and wherein same is secured to opposite portal frame subsections along upper edges only, and wherein subsequent to pouring of the concrete floor, the upward bow in said floor frame subsection disappears and said floor frame subsection is further secured to said portal frame subsections.

5. The process as defined in claim 4 wherein the trackway forms a series of loops, said finishing stations being located along said trackway, said module frame being movably therealong in directions axial and transverse to a longitudinal axis through said frame.

6. A process for producing a building module comprising the steps of:

(a) fabricating a pair of portal frame subsections, a floor frame subsection and a roof frame subsection;

(b) positioning one of said portal frame subsections at a predetermined locations at a module frame assembly site and temporarily supporting same in a proper assembly attitude thereat with jigs;

(c) positioning said floor frame subsection adjacent said supported portal frame subsection and temporarily supporting same at a proper assembly attitude with respect to said one portal frame with jigs;

(d) positioning said other portal frame subsection at a predetermined location at said module assembly site at an end of said floor frame and temporarily supporting same in a proper assembly attitude thereat with jigs;

(e) positioning said roof frame subsection between said supported portal frame subsections and temporarily supporting same thereat in a proper assembly attitude with respect to said portal frames;

(f) securing said floor and roof frame subsections to said portal frame subsections to define a module frame;

(g) raising said module frame, removing said jigs for said portal frame subsections and said roof frame subsection, removably securing trackway roller means to said portal frame subsections and lowering said module frame until said roller means are received on a trackway and said floor frame jigs are removed therefrom;

(h) moving said module frame along said trackway to a floor station, and producing a monolithic reinforced concrete floor in situ on said floor frame of said module thereat;

(i) adding roofing materials to said roof frame of said module to define a roof therefor; and (j) moving said module frame along said trackway past a plurality of finishing stations and finishing a predetermined portion of said module at each station so that the module is virtually complete when it is moved away from the last of said finishing stations, and ready for transit to building site.

7. The process of defined in claim 6 wherein said jig elements are pivotal between an operative support position and an inoperative nonsupport position.

8. The process as defined in claim 7 wherein said portal frame subsections are positioned by setting same onto pins extending from the floor and wherein said jig elements therefor are contactable with connector pins extending from an upper end of said portal frame subsections to maintain same vertical and properly spaced apart.

9. The process as defined in claim 6 wherein two elongated jigs are located along opposite sides of said assembly site, each of said elongated jigs having separate jig elements received thereon for each of said portal frame subsections and for said roof frame subsection, said jig elements being movable between a retracted position and an extended supporting position and said floor frame supporting jigs are locate at opposite ends of said assembly site between said elongated jigs, said floor jigs being operatively associated with hydraulic jacks located in the floor, said jacks being movable between a recessed nonsupporting position and an extended frame lifting position for securement of said trackway roller means to said portal frames.

10. The process as defined in claim 6 wherein said final frame assembly site is located within a building structure and said module frame is moved along said trackway outside of said building for completion of said module.

11. A process for producing a building module comprising the steps of:

(a) fabricating two portal frame subsections, a floor frame subsection and a roof frame subsection, all of said subsections being skeletal metal subsections;

(b) positioning one of said portal frame subsections on mounting means therefor at a module frame assembly site and bringing jigs and said portal frame into engagement to properly locate and support said portal frame at a proper attitude for subsequent frame assembly;

(c) positioning said floor frame subsection adjacent said supported portal frame subsection and bringing hydraulic jack floor jigs and said floor frame subsections into engagement to properly locate and support said floor frame at a proper attitude for subsequent frame assembly;

(d) positioning said other of said portal frames on mounting means therefor at said module frame assembly site, adjacent a free end of said frame subsection and bringing jigs and said portal frame into engagement to properly locate and support said portal frame at a proper attitude for subsequent frame assembly;

(e) positioning said roof frame subsection between said supported portal frames and above said floor frame and bringing jigs and said roof frame into engagement to properly locate and support said roof frame at a proper attitude for frame assembly;

(f) securing said metal frame subsections to adjacent frame subsections while said jigs are in engagement therewith to define a skeletal module frame;

(g) securing roofing materials to said roof frame to produce a roof thereacross while at the frame assembly site;

(h) removably securing forms to said floor frame while at the frame assembly site for subsequent production of a concrete floor therewithin;

(i) raising said hydraulic jack floor jigs to raise said module frame withdrawing said support jigs for said portal frames and said roof frame, removably securing separate trackway roller means to each end of said portal frames and lowering said module frame onto a trackway provided therefor and removing said floor jigs;

(j) moving said module frame along said trackway to a floor station and producing a monolithic reinforced concrete floor in situ within said forms secured to said floor frame, removing said forms from said floor frame after said concrete floor is cured; and (k) moving said module frame along said trackway past a plurality of finishing stations and finishing a predetermined portion of said module at each station so that said module is virtually complete when it is moved away from the last of said finishing stations and ready for transit to a building site.

12. The process as defined in claim 6 wherein said trackway defines at least one loop therein, concrete pouring, finishing and curing stations being located in said loop for receiving a plurality of module frames thereat where concrete floors are sequentially produced for said plurality of frames in said loop, and wherein said module frames with concrete floors produced thereon are then moved on said trackway past remaining finishing stations where said module is completed.

13. The process as defined in claim 6 wherein said roller means are adapted for spaced apart connection to roller means on an adjacent module whereby a plurality of modules may be interconnected and moved simultaneously.

* * * * *